US006003215A

United States Patent [19]

St. Jacques

[11] Patent Number: 6,003,215

[45] Date of Patent: Dec. 21, 1999

[54] APPARATUS FOR REPLACEMENT OF NEEDLE BOARDS IN A NEEDLE LOOM

[75] Inventor: Todd M. St. Jacques, Adams, Mass.

[73] Assignee: Morrison Berkshire, Inc., North Adams, Mass.

[21] Appl. No.: 09/204,023

[22] Filed: Dec. 1, 1998

[51] Int. Cl.[6] ..... D04H 18/00

[52] U.S. Cl. ..... 28/115; 28/107

[58] Field of Search ..... 28/107, 115, 114, 28/109, 110, 111; 414/331, 788, 788.1, 788.4, 790.1, 790.4, 288

[56] References Cited

U.S. PATENT DOCUMENTS

| | | | |
|---|---|---|---|
| 3,889,326 | 6/1975 | Tyas | 28/115 |
| 4,777,706 | 10/1988 | Stanislaw . | |
| 4,878,799 | 11/1989 | Seto et al. | 414/331 |
| 4,884,324 | 12/1989 | Stanislaw . | |
| 4,926,530 | 5/1990 | Stanislaw . | |
| 5,117,541 | 6/1992 | Leuchtenmuller | 28/115 |
| 5,287,604 | 2/1994 | Feyerl | 28/115 |

FOREIGN PATENT DOCUMENTS

| | | | |
|---|---|---|---|
| 1134637 | 1/1985 | Japan | 28/115 |

*Primary Examiner*—Amy B. Vanatta
*Attorney, Agent, or Firm*—Lerner, David, Littenberg, Krumholz & Mentlik, LLP

[57] ABSTRACT

A needle board storage apparatus is used for the removal, storage, and transport of needle boards during replacement in a needle loom. The apparatus includes a two stage magazine designed to accommodate two full compliments of needle boards for any needle zone in a given needle loom. One stage of the magazine provides independent storage for spent needle boards as they are removed from the needle loom, while the other stage contains replacement needle boards that will later be loaded into the loom. An assembly allows the entire magazine to be moved from a first stage position for unloading spent needle boards to a second stage position for loading replacement needle boards. Needle board receiver openings on the magazine in registration with each stage are positioned at the exact height of the needle zones of the needle loom so the operator can roll the needle boards directly to or from the loom into the magazine with minimal or no handling in-between. A mechanism allows the operator to index needle board positions inside each stage of the magazine providing vacancies for spent needle boards as they are removed from the loom (or exposing replacement boards for loading into the loom).

95 Claims, 15 Drawing Sheets

APPARATUS FOR REPLACEMENT OF NEEDLE BOARDS IN A NEEDLE LOOM

FIELD OF THE INVENTION

The present invention generally relates to needle looms having at least one zone containing a plurality of needle boards utilized for the manufacture of endless needled fabric webs, and more particularly, to an apparatus and method which simplifies the replacement of worn or damaged needles and/or needle boards with a minimum amount of operator involvement and needle loom down time.

BACKGROUND OF THE INVENTION

Manufacturing of papermakers' fabrics traditionally include a number of different types of machines and equipment. For instance, manufacturing plants generally include a weaving loom for weaving of the base fabrics which, for example, may comprise woven monofilament mesh fabrics, a finishing machine onto which the base fabric produced on the weaving loom is placed for heat treating or setting of the woven base fabric in order, for example, to fix the size of the fabric, and a needle loom for needling fibrous material to the base fabric to fully integrate and unite the fibrous material into and amongst the base fabric and themselves.

In addition, these plants also generally include a batt-making line for producing a carded fiber web or batt of narrow width, and a cross lapping apparatus for producing a cross-layered fibrous web of a width corresponding to the width of the base fabric. The cross-layered fibrous web may be applied directly from the cross lapping apparatus to the base fabric, or may first be tacked together, rolled onto a separate roll and then later unwound for being applied to the base fabric. The batt-making line may, in turn, include equipment for opening of textile fibers, equipment for blending of the fibers, and equipment for carding or orienting of the fibers to produce the carded fiber web or batt.

Needle looms are complicated, sophisticated pieces of equipment which generally have a plurality of separate needling stations or zones, each of which generally includes a plurality of juxtaposed needle boards mounted to a machine frame so as to extend across the working width of the loom. The needle boards each include a multiplicity of needles arranged in rows and columns which are moved up and down to pierce the fiber layer applied to the endless base fabric in order to lock the fibers to the base fabric. Generally, several passes are made past the needling stations in order to fully and properly needle the fibrous layer to the base fabric. Further, when needling cross-layed fibrous webs to the base fabric, the full-width needle boards are initially operated so as to tack the cross-layed web in place in order to initially hold the layed fibrous material in place. The tacking operation is generally accomplished at a slow stroke rate, but at a high fabric advance rate per loom stroke.

After the fibrous material has been tacked in place, the needle boards are then operated utilizing the needles at full penetration to fully lock and unite the fibrous material to the base fabric. This is accomplished at a faster speed than that at which the fibers are initially tacked in place, and thus, the needle loom has a greater throughput. After complete and full needling, the endless fabric web having the fiber layer needled thereon is taken off and may be placed on a finishing machine for heat-setting of the finished felts and/or for other surface treatments, such as compaction, washing and/or vacuuming.

In terms of the operational process in the manufacture of endless papermakers' felts, the piece of equipment generally having the most downtime, and also, the most expensive piece of equipment, is generally the needle loom. In terms of the speed of operation, in present day plants, only one finishing machine is required for every two to three needle looms. That is, one finishing machine in a plant can supply finished, heat set base fabrics for two to three needle looms operating at conventional speeds and/or can finish or surface condition produced felts from two to three needling looms. Simply put, conventional needling looms are among the most expensive pieces of machinery in a papermakers, felt production plant, and also, among the slowest operating by virtue of having a substantial amount of downtime. Downtime results from a number of factors, for example, set up time for the fabric and needle boards, needle board repair and replacement, etc. As a result, the run or operating time of the needling loom is often small compared to the downtime. For example, it has been determined that in certain applications the needle loom downtime has resulted in loom utilization of only about fifteen percent of the total number of hours available. Consequently, it is most important in order to efficiently and economically produce endless needled fabric to minimize needling loom downtime and to maintain the needling looms operating at full capacity and performing their intended needling functions at all times, i.e., increasing overall availability of the needling loom.

During operation of the needle loom, the needles of the needle board are initially subjected to natural wear, as well as a more or less large amount of needle breakage. As a consequence, an increasingly larger number of needles are no longer available for the needling process. Needles which fail during operation of the needle loom increasingly deteriorate the quality of the produced needled fabric. Damage to the needles reduces the usability of the needle board earlier than the time set at which, due to general wear, all needles would be replaced or a replacement of the entire needle board and the attached needles. In addition, it is known to periodically replace a percentage of the needles, typically the oldest needles, even though they are not broken. For example, maintenance of the needle boards might include replacement of one or more rows of needles every three to four days of needle loom operation. Accordingly, a needle board at any one time will contain needles of varying age and wear.

The needle boards are arranged in the needle loom in one or more zones overlying and/or underlying the endless fabric web to be needled. A typical needle loom, such as a duplex loom in which needling of the endless fabric web occurs concurrently from both above and below the web being processed, may include four zones of needle boards. Each zone may include, for example, eight to ten needle boards (each needle board having seventeen rows of needles) which ultimately require replacement when the needles become worn and/or damaged during operation of the needle loom.

The needle boards have previously been replaced by manual operation. In this regard, an operator after stopping operation of the needle loom, would withdraw a needle board from a needle board zone one board at a time. The withdrawn needle boards would be manually transported from the needle loom to a storage cart. Once all of the needle boards for a given zone were removed, the replacement needle boards would be inserted into the needle loom, one needle board at a time. This replacement process would require that an operator be constantly manually transporting worn or damaged needle boards withdrawn from the needle loom and replacement needle boards back and forth between one or more designated storage carts. Due to the large number of needle boards, the replacement process could take anywhere from six to eight hours per needle loom zone. As previously noted, it is most important in order to efficiently and economically produce endless needled fabric webs that the needle looms be operating continuously at full capacity at all times. Thus, the extended down time of the needle loom for needle board replacement has been recognized as a serious drawback in the efficient and economical production of needled fabric webs.

Accordingly, there is an unsolved need for an apparatus and method to enable the removal and replacement of needle boards in a needle loom with a minimum amount of needle loom down time and operator intervention so as to maintain the efficient and economical operation thereof in the production of endless needled fabric webs.

SUMMARY OF THE INVENTION

The present invention expedites the removal of needle boards from needle looms thereby reducing loom down time and increasing overall loom performance. Because the present invention requires less operator intervention than heretofore known, an increased margin of operator safety may be achieved. The present invention may be integrated into the design of new needle looms, as well as a retrofit design for existing looms.

To this end, the apparatus of the present invention is used for the removal, storage, and transport of needle boards during replacement in a needle loom. The apparatus includes a two stage magazine designed to accommodate two full compliments of needle boards for any needle zone in a given needle loom. One stage of the magazine provides independent storage for spent needle boards as they are removed from the needle loom, while the other stage contains replacement needle boards that will later be loaded into the loom. A linear slide assembly allows the entire magazine to be moved from a first stage position for unloading spent needle boards to a second stage position for loading replacement needle boards with minimal physical effort. Needle board receiver openings on the magazine in registration with each stage are positioned at the exact height of the needle zones of the needle loom so the operator can roll the needle boards directly to or from the loom into the magazine with minimal or no handling in-between. A manually or motor operated mechanism allows the operator to index needle board positions inside each stage of the magazine providing vacancies for spent needle boards as they are removed from the loom (or exposing replacement boards for loading into the loom). The apparatus may be mounted on heavy duty casters for easy transport of needle boards to and from the needle loom and may have precision locating pins to rapidly and accurately position the apparatus in front of the needle loom during needle board replacement.

The apparatus of the present invention may be integrated into a system to expedite the process of needle board removal by integrating the operation of various system components relating to the needle board, e.g., needle board clamp, needle board locators, needle board removal wheels and needle board connecting links. The needle board clamp is a fully automatic pneumatic clamp that is used to fasten the needle boards in the needle loom. A single solenoid valve energizes (or deenergizes) the clamp that locks all the needle boards for a single zone into one or more needle board modules. The needle board locators are precision machined locating pins used to accurately align the needle boards in the needle board modules before they are clamped in place. These locators eliminate the time previously required by the needle loom operator to manually align the boards prior to clamping them in place. Each needle board is equipped with removal wheels that allow the loom operator to roll the board in or out of the needle loom with minimal physical effort. Guides or tracks for the wheels allow the boards to be rolled the entire width of the needle loom for removal at the "open end" of the loom. Individual needle boards are interconnected by the needle board connecting links which allow the loom operator to extract all the boards from a fixed position at the "open end" of the needle loom. The links also serve to accurately maintain the needle board to needle board positioning when installed in the needle loom.

In accordance with one embodiment of the present invention there is described an apparatus for the storage of a plurality of needle boards for a needle loom, the apparatus comprising a housing, a plurality of first compartments within the housing adapted for storing a plurality of needle boards upon removal from the needle loom, a plurality of second compartments within the housing adapted for storing a plurality of needle boards to be inserted into the needle loom, and an indexing assembly in operative association with the first and second compartments, the indexing assembly positioning each of the first compartments adjacent a predetermined position within the housing for receiving a needle board removed from the needle loom and each of the second compartments adjacent another predetermined position within the housing for removing a needle board therefrom to be inserted into the needle loom.

In accordance with another embodiment of the present invention there is described an apparatus for the storage of a plurality of needle boards for use in a needle loom, the apparatus comprising a housing including a front side having first and second openings therein, a first storage area within the housing including a plurality of first compartments each movable to a position opposing the first opening for receiving a needle board removed from the needle loom, a second storage area within the housing including a plurality of second compartments each movable to a position opposing the second opening for storing replacement needle boards to be inserted into the needle loom, and an indexing assembly operatively associated with the first and second compartments, the indexing assembly positioning each of the first compartments opposing the first opening and each of the second compartments opposing the second opening.

In accordance with another embodiment of the present invention there is described a needle board for use in a needle loom, the needle board comprising a substrate bound by a plurality of edges having an opening adjacent one edge thereof, a pin protruding from one edge of the substrate for capture within the opening within a substrate of an adjacent needle board thereby releasably interconnecting at least a pair of the needle boards together, a locator adjacent one edge of the substrate for engagement with a portion of the needle loom when the substrate is inserted therein, thereby aligning the substrate within the needle loom at a predetermined position, and a wheel adjacent an edge of the substrate for engagement with the needle loom thereby facilitating the insertion of the substrate within the needle loom.

In accordance with another embodiment of the present invention there is descried a needle board for use in a needle board module having a guide track for the insertion and removal of needle boards from within a needle loom, the needle board comprising a substrate having a plurality of needles bound by a pair of side edges and a pair of end edges, a connecting link protruding outwardly from one of the end edges of the substrate having a pin for capture within an opening within a substrate of an adjacent needle board thereby releasably interconnecting a pair of the needle boards together in end-to-end relationship, a locator adjacent one of the side edges of the substrate for engagement with a portion of the needle board module when the needle board is received therein along the guide track thereby aligning the needle board within the needle board module at a predetermined position, a wheel adjacent each of the side edges of the substrate for rolling engagement along the guide track thereby facilitating insertion of a plurality of needle boards into the needle board module when the needle boards are interconnected by means of the connecting link.

In accordance with another embodiment of the present invention there is described a system for inserting and removing a plurality of needle boards from a needle loom, the system comprising a plurality of needle boards insertable and removable from the needle loom at one end thereof, a needle board storage apparatus moveable to a position adjacent the one end of the needle loom, the apparatus including a plurality of first compartments adapted for storing a plurality of needle boards upon removal from the needle loom and a plurality of second compartments adapted for storing a plurality of needle boards to be inserted into the needle loom, and an indexing assembly in operative association with the first and second compartments, the indexing assembly positioning each of the first compartments adjacent a predetermined position within the apparatus for receiving a needle board removed from the needle loom and each of the second compartments adjacent another predetermined position within the apparatus for removing a needle board therefrom to be inserted into the needle loom.

In accordance with another embodiment of the present invention there is described a system for inserting and removing a plurality of needle boards from a needle loom, the system comprising a needle loom having at least one needle zone operative for reciprocating a plurality of needle board modules therein, the needle board modules including a guide track for moveable support of the needle boards into and out of the needle board modules at one end of the needle loom for replacement of the needle boards, a needle board storage apparatus moveable from a first position adjacent the one end of the needle loom to a second position remote therefrom, the apparatus including a front side having a first and second opening, a first storage area within the apparatus including a plurality of first compartments each movable to a position opposing the first opening within the front side for receiving a needle board removed from the needle board modules, a second storage area within the apparatus including a plurality of second compartments each movable to a position opposing the second opening within the front side adapted for receiving therethrough a needle board stored within the second compartments for insertion into the needle board modules, and an indexing assembly operatively associated with the first and second compartments, the indexing assembly positioning each of the first compartments opposing the first opening for receiving the needle boards from the needle loom for storage within the first storage area and positioning each of the second compartments opposing the second opening for withdrawing a needle board through the second opening from an opposing second compartment for insertion into the needle loom.

In accordance with another embodiment of the present invention there is described a method of replacing a plurality of needle boards in a needle loom, the method comprising the steps of positioning a needle board storage apparatus adjacent the needle loom having a plurality of needle boards to be replaced, the apparatus including a plurality of first and second compartments, inserting a plurality of replacement needle boards into a corresponding plurality of the second compartments, withdrawing each of the needle boards from the needle loom and inserting the withdrawn needle boards into a corresponding plurality of first compartments, and removing the replacement needle boards from the second compartments and inserting the replacement needle boards into the needle loom.

In accordance with another embodiment of the present invention there is described a method of replacing a plurality of needle boards in a needle loom, the needle loom having at least one needle zone operative for reciprocating a plurality of needle boards therein, the method comprising the steps of positioning a needle board storage apparatus adjacent the needle loom opposing the needle zone, the apparatus including a plurality of first and second compartments each operative for storing a needle board therein, the first compartments being accessible through a first opening in the apparatus and the second compartments being accessible through a second opening in the apparatus, connecting the apparatus to the needle loom to provide communication between the apparatus and the needle zone, inserting a plurality of replacement needle boards into a corresponding plurality of second compartments, withdrawing each of the needle boards from within the needle zone, sequentially aligning each of the first compartments with the first opening in the apparatus and inserting into the aligned first compartments the needle boards removed from the needle zone, sequentially aligning each of the second compartments with the second opening in the apparatus and withdrawing each of the replacement needle boards from the apparatus, and inserting the withdrawn replacement needle boards into the needle zone in end to end relationship.

BRIEF DESCRIPTION OF THE DRAWINGS

The above description, as well as further objects, features and advantages of the present invention will be more fully understood with reference to the following detailed description of an apparatus for replacement of needle boards in a needle loom, when taken in conjunction with the accompanying drawings, wherein.

DETAILED DESCRIPTION OF THE PREFERRED EMBODIMENTS

Figure 1:
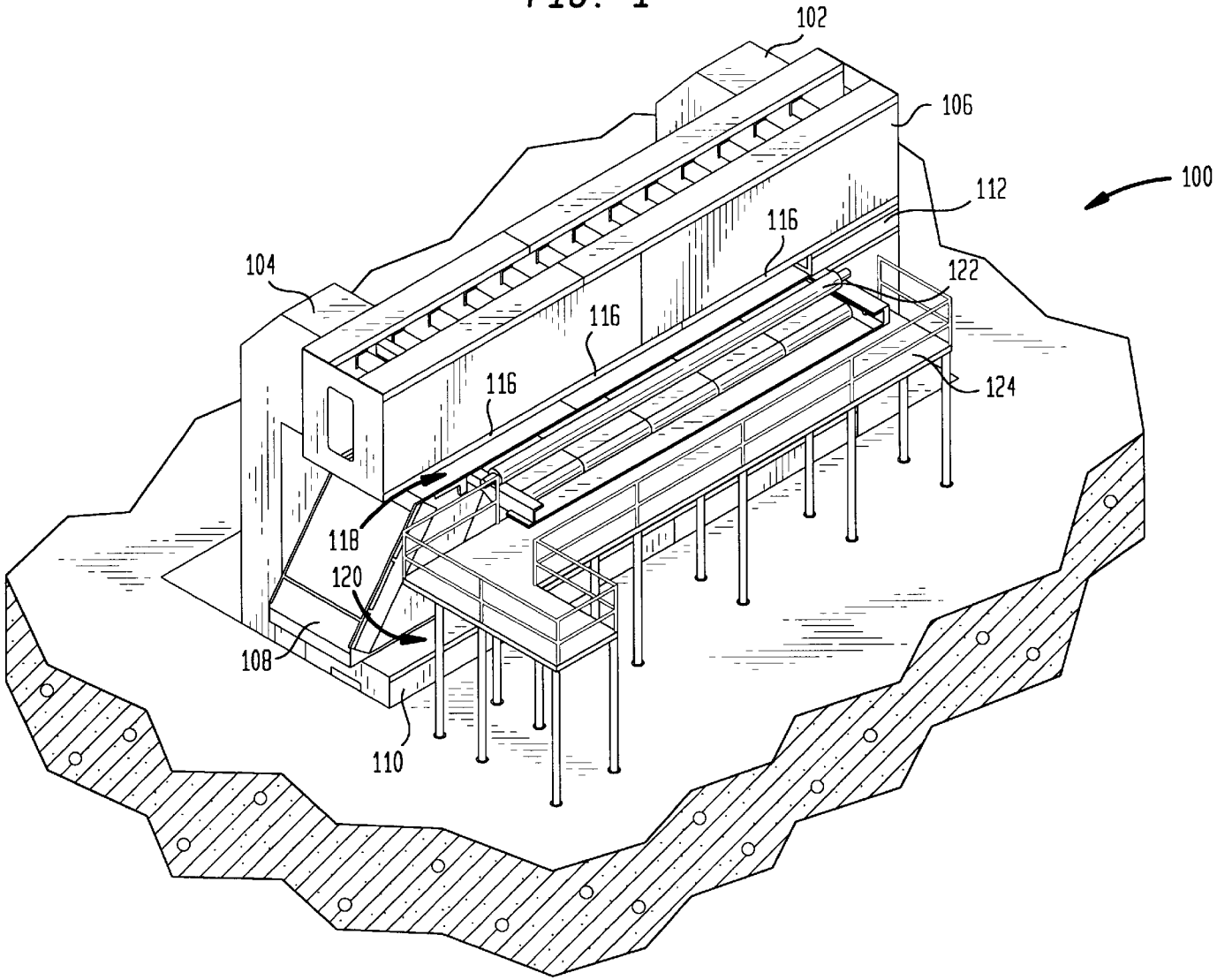
FIG. 1 is a perspective view diagrammatically illustrating a needle loom for manufacture of endless needled fabric webs incorporating a plurality of needle boards.
Figure 2:
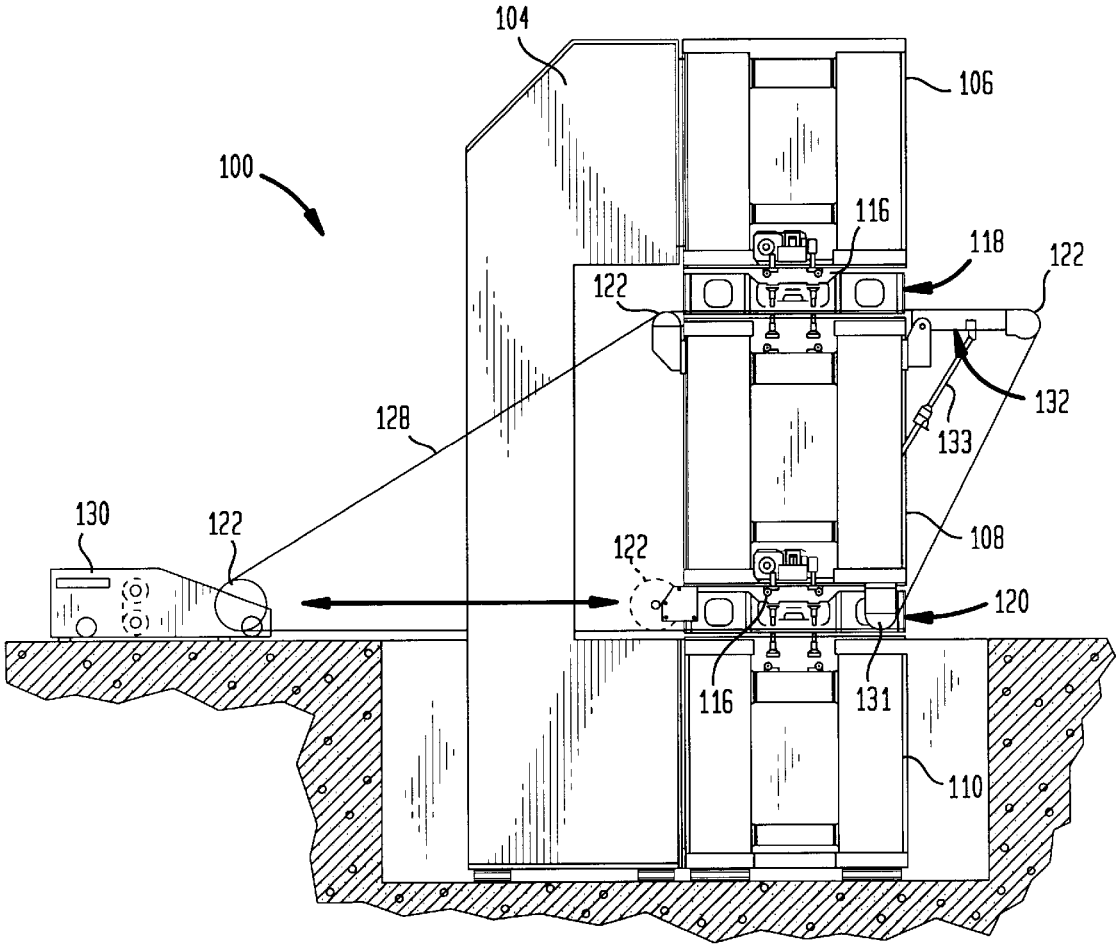
FIG. 2 is a front elevational view of the needle loom generally illustrated in FIG. 1 showing a duplex construction having upper and lower needle board zones.
Figure 3:
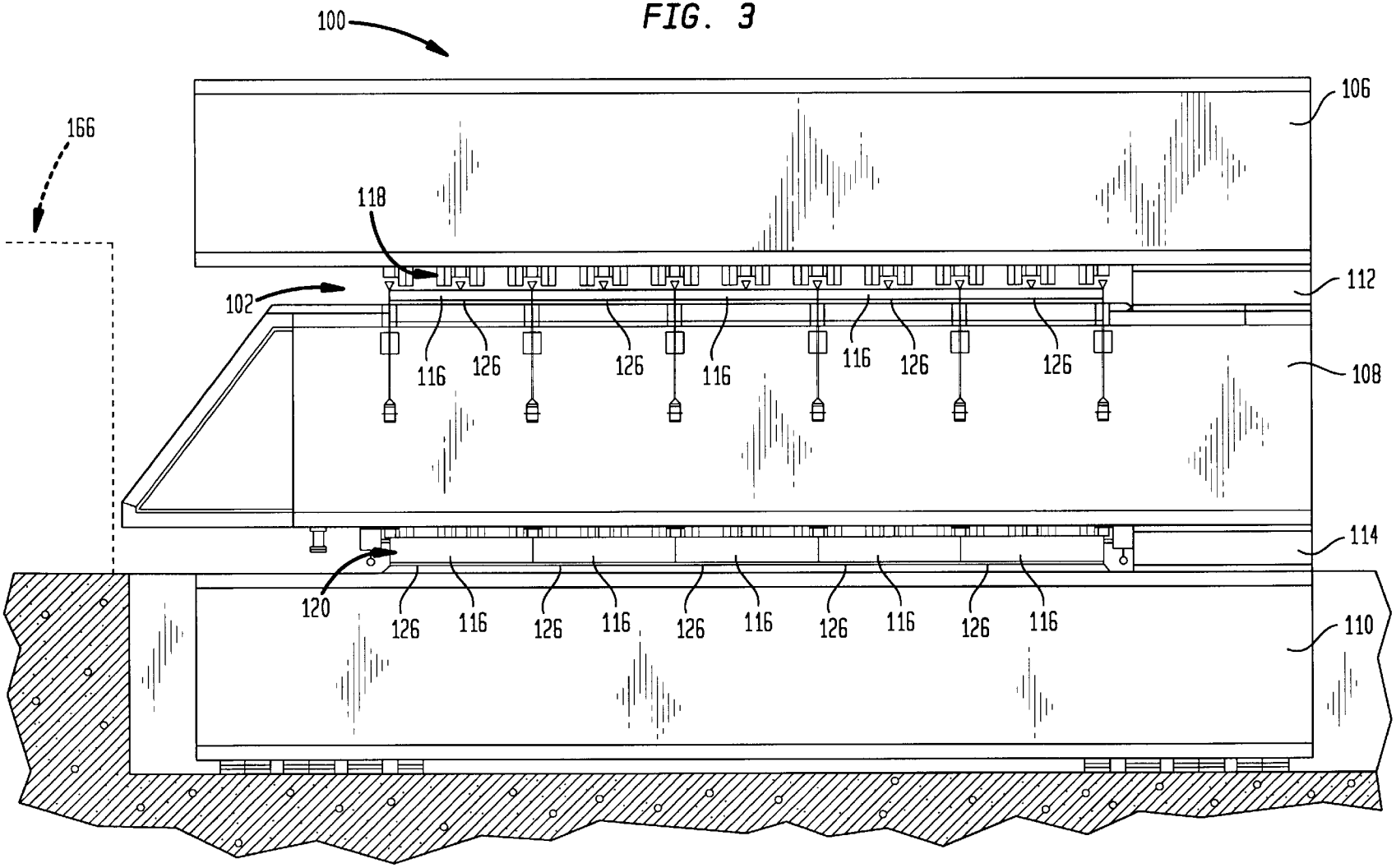
FIG. 3 is a side elevational view of the needle loom as illustrated in FIG. 2.
Figure 4:
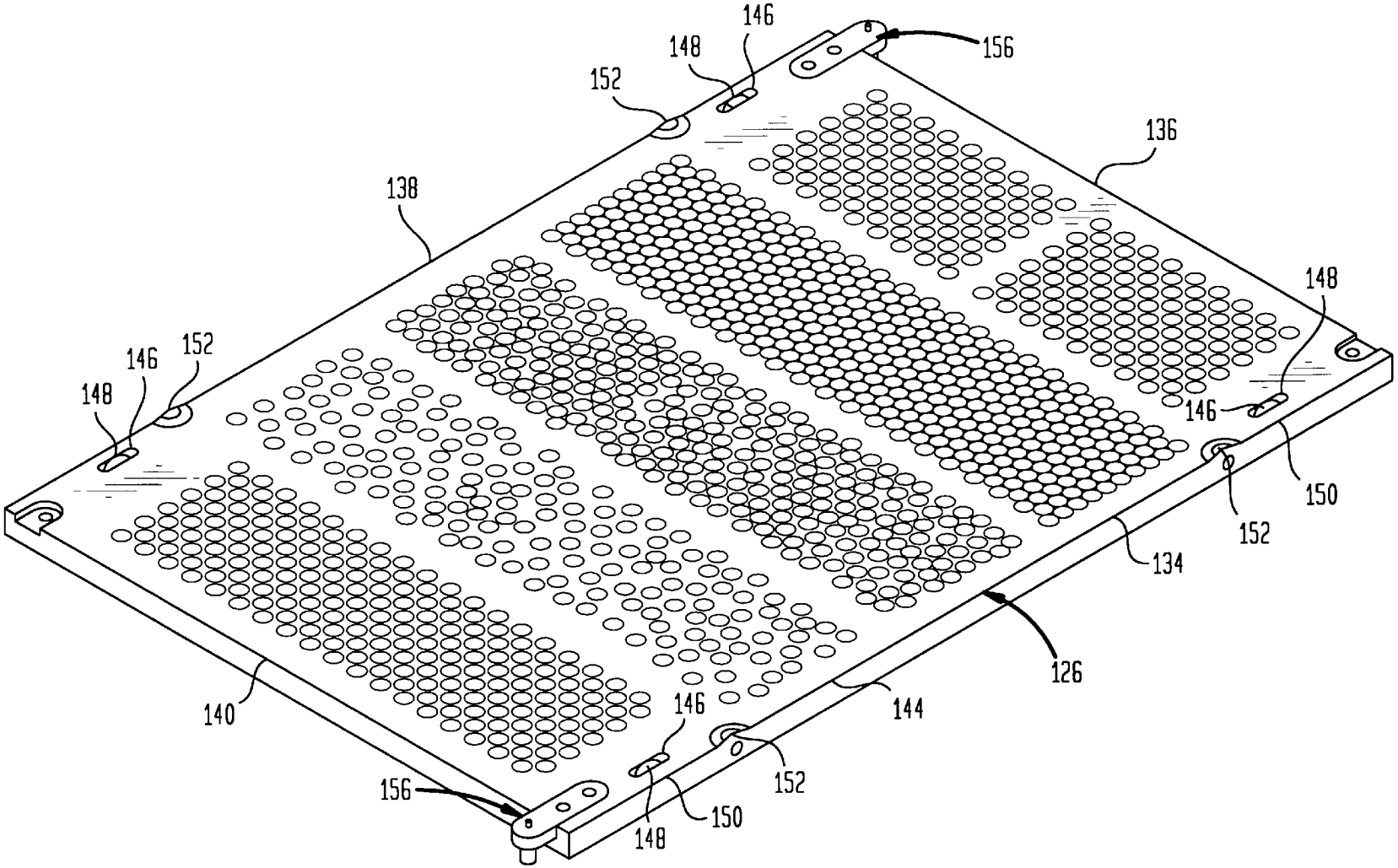
FIG. 4 is a perspective view of a needle board illustrating various construction features in accordance with one embodiment of the present invention.
Figure 5:
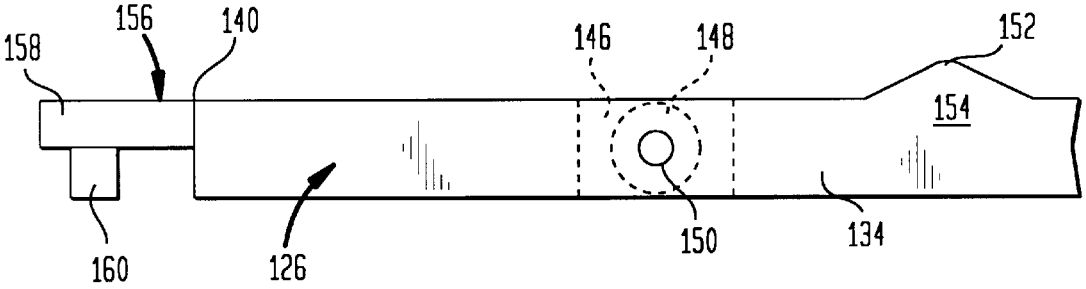
FIG. 5 is a front elevational view of a portion of the needle board illustrating certain construction features shown in FIG. 4.
Figure 6:
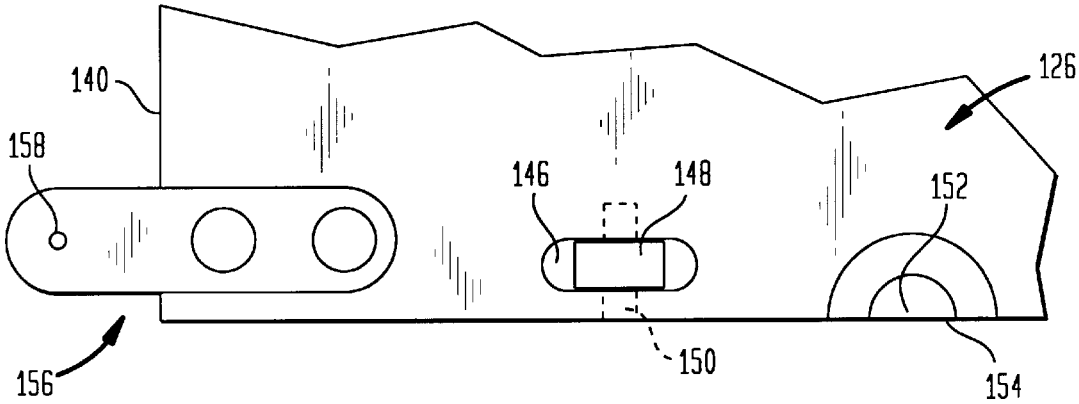
FIG. 6 is a top plan view illustrating certain construction features of the needle board as shown in FIG. 5.
Figure 7:
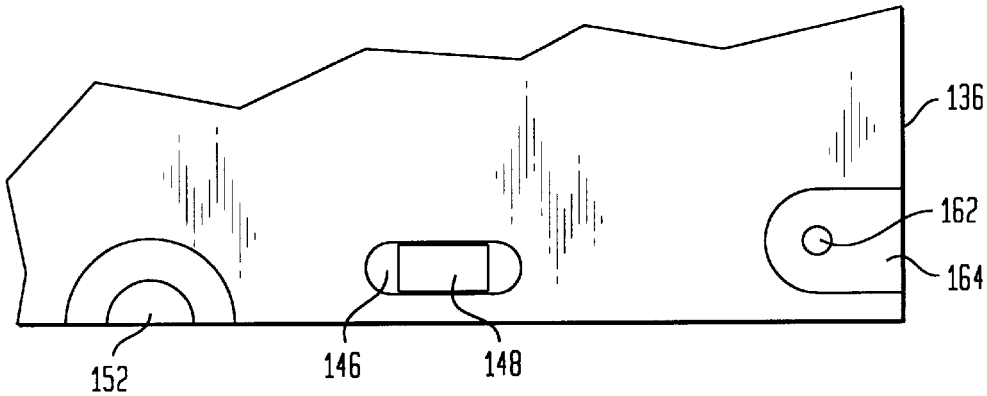
FIG. 7 is a top plan view illustrating certain construction features of the needle board as shown in FIG. 4.
Figure 9:
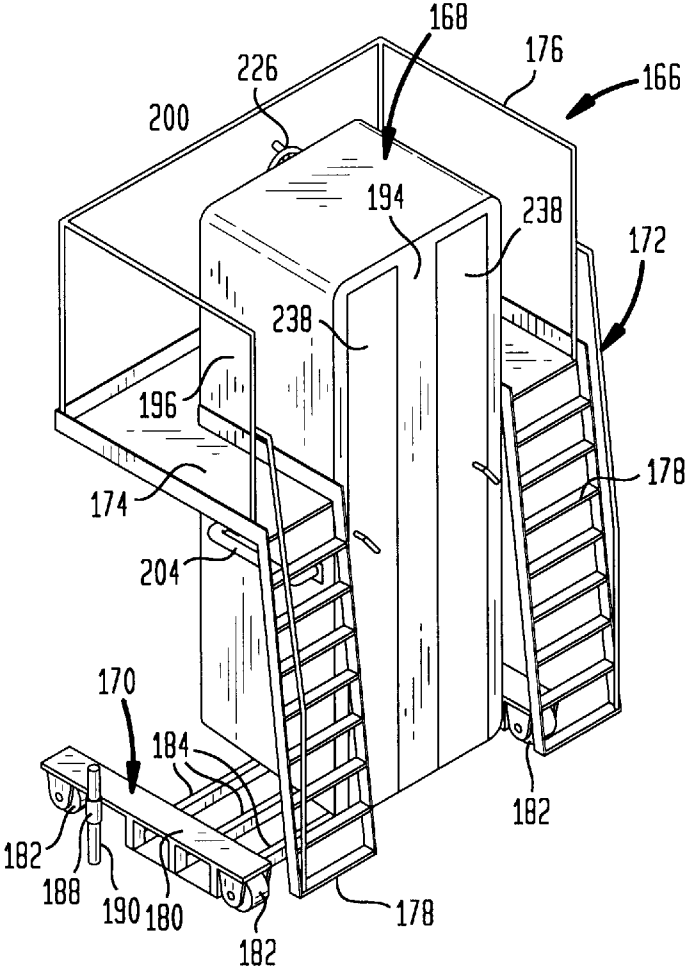
FIG. 9 is a rear perspective view of the needle board storage apparatus illustrated in FIG. 8.
Figure 8:
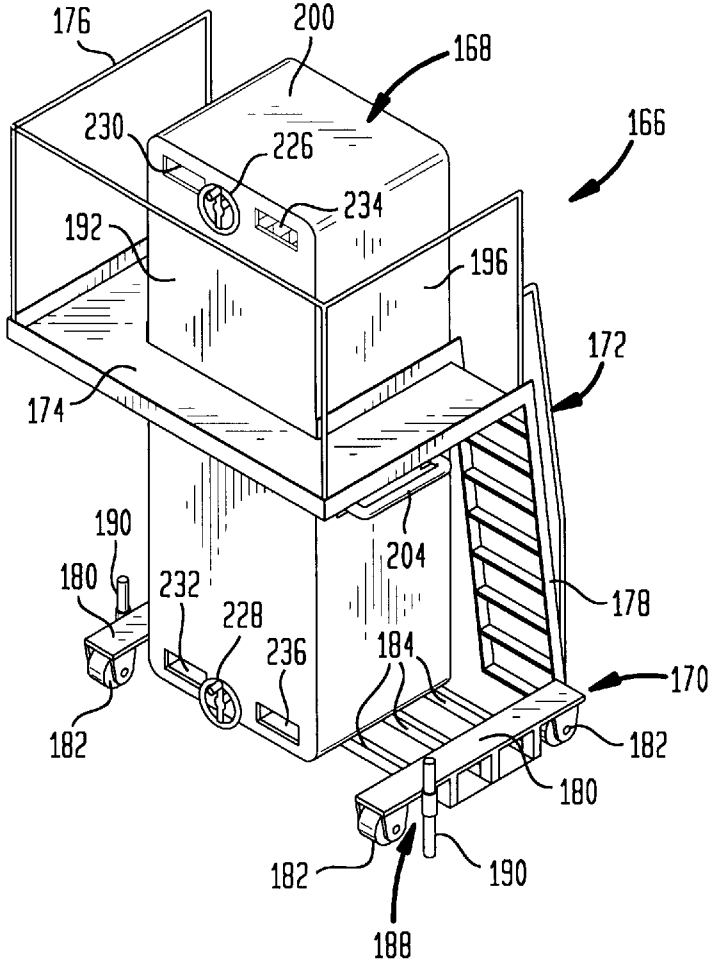
FIG. 8 is a front perspective view of a needle board storage apparatus constructed in accordance with one embodiment of the present invention.
Figure 10:
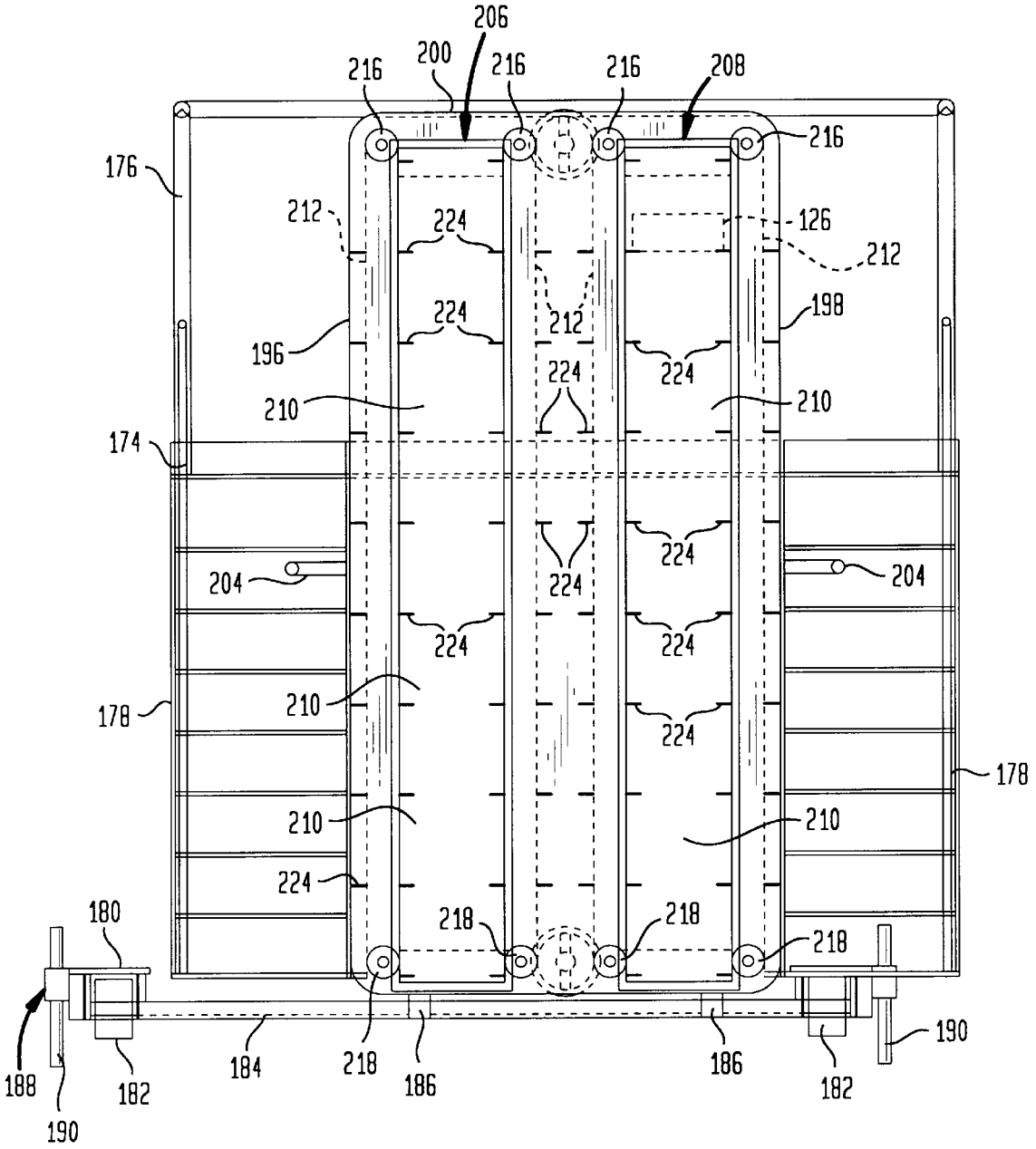
FIG. 10 is a rear elevational view of the needle board storage apparatus, in partial cross-section, illustrating a two stage magazine having a plurality of compartments for separately storing worn or damaged needle boards and replacement needle boards.
Figure 11:
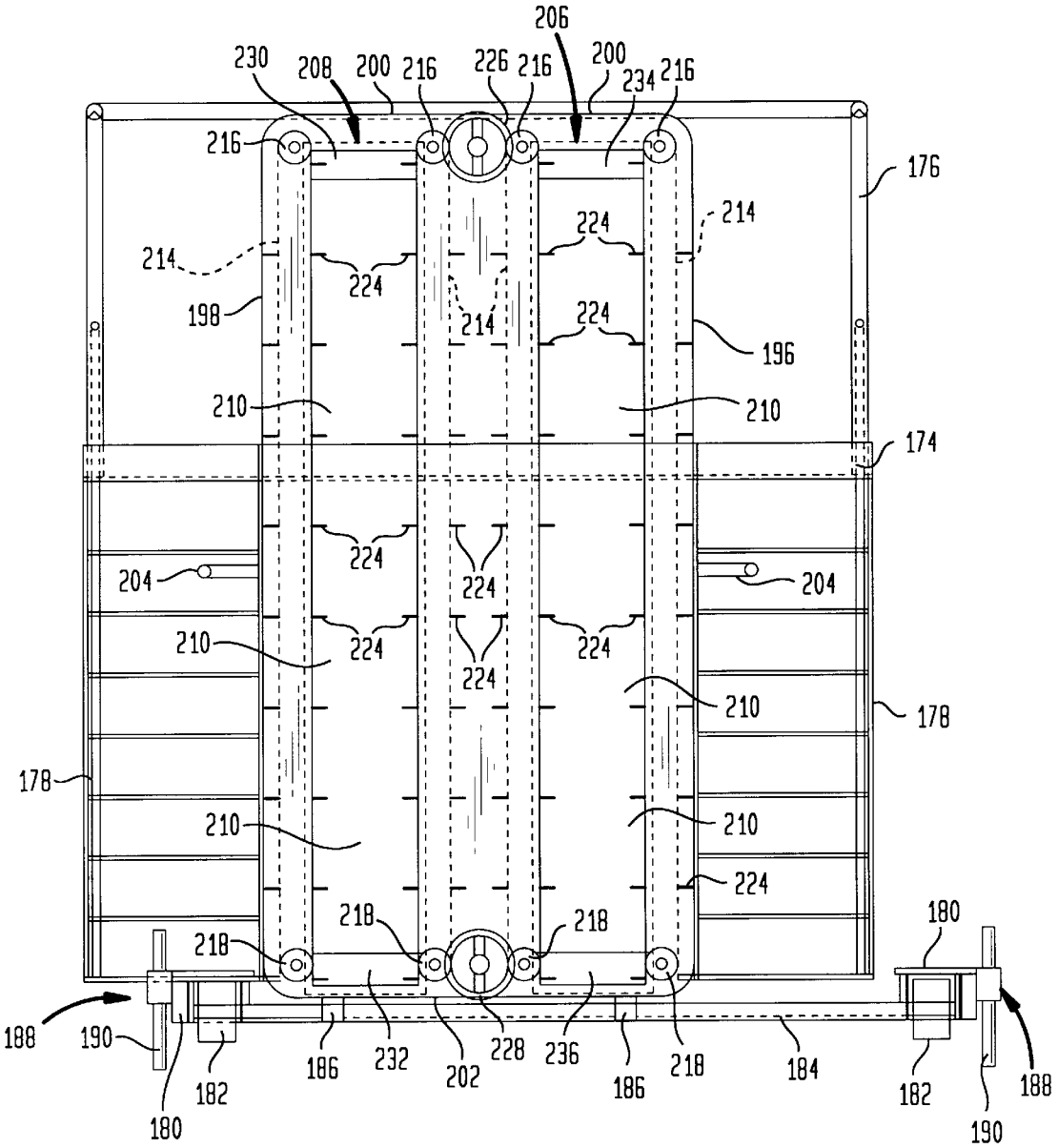
FIG. 11 is a front elevational view of the needle board storage apparatus, in partial cross-section.
Figure 12:
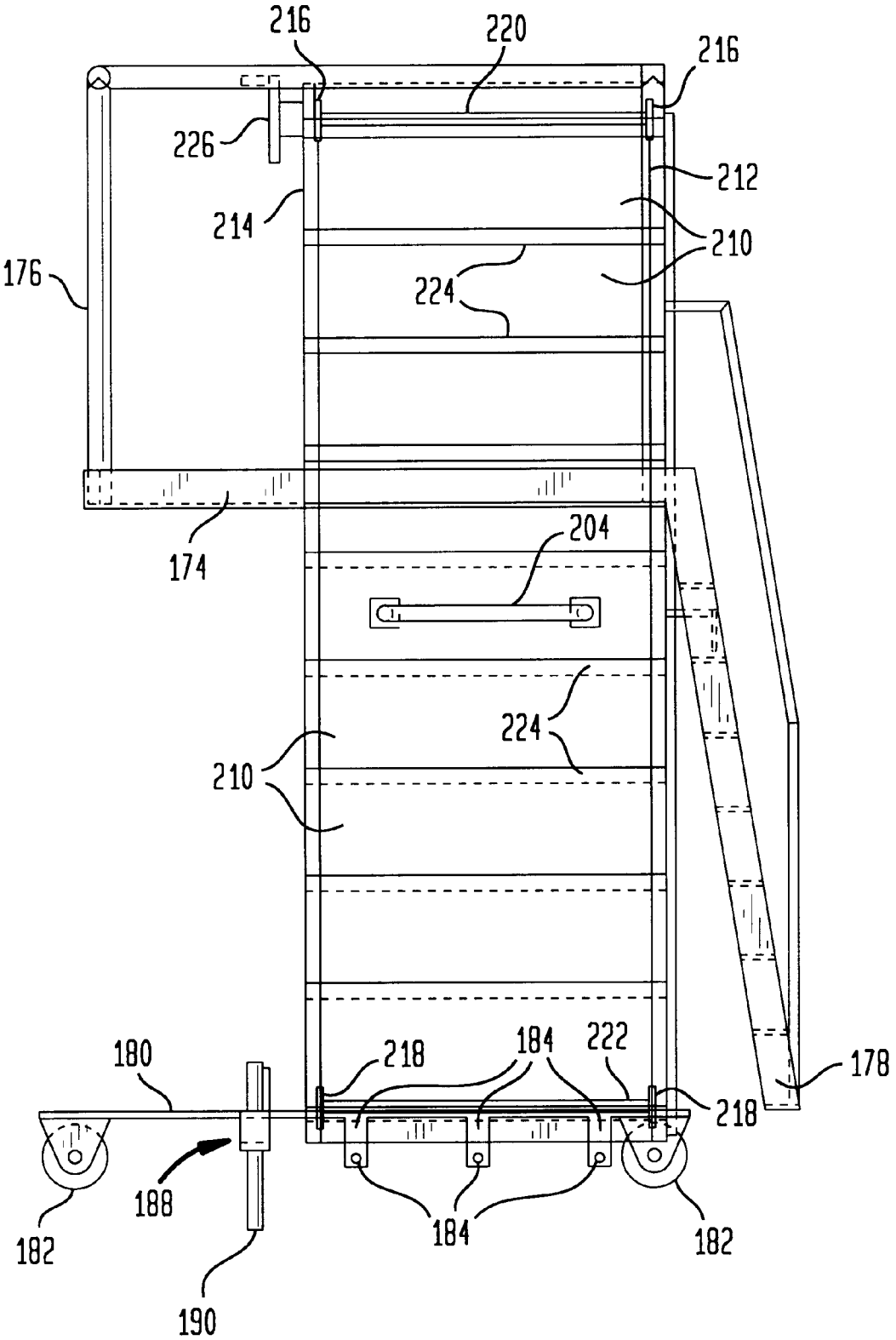
FIG. 12 is a side elevational view of the needle board storage apparatus, in partial cross-section.

Turning now to the drawings, wherein like reference numerals represent like elements, there is shown in FIGS. 1–3 a needle loom generally designated by reference numeral 100. The needle loom 100 illustrated, by way of example, is a high speed needle loom having two zones such as available from Morrison Berkshire, Inc. of North Adams, Mass. The construction of a needle loom 100, of the aforementioned type, is generally described in U.S. Pat. Nos. 4,926,530, 4,884,324 and 4,777,706, all assigned to Morrison Berkshire, Inc., the disclosures of which are incorporated herein by reference.

Generally, a needle loom 100 of the aforementioned type includes a pair of spaced apart open end frames 102, 104, a top spar 106, a bottom beam 108, a base beam 110, intermediate supports 112, 114, a plurality of needle board modules 116 arranged in upper and lower needle board zones 118, 120, a plurality of endless fabric web supporting rollers 122 and a utility catwalk 124. The main areas of the needle loom 100 to which the present invention is directed are the upper and lower needle board zones 118, 120. As is conventional, the needle loom 100 includes a plurality of needle board modules 116 which are operatively interconnected, being supported by the top spar 106 and bottom beam 108 in one or more rows extending transversely across the entire width of the needle loom. Each of the needle board modules 116 will support one or more needle boards 126, see FIG. 3, each of which includes a plurality of needles 127 (see FIG. 18).

An endless fabric web 128, see FIG. 2, to be needled is threaded into or loaded onto the needle loom 100 so as to follow an endless path defined by the rollers 122. The endless fabric web 128 coextensively extends within the upper and lower needle board zones 118, 120 so as to be in operative association with the plurality of needle board modules 116. A loom tensioning assembly 130 is operative for movement of its end supported roll 122 as shown in the far left portion of FIG. 2 towards and away from the bottom beam 108 for loading and unloading the endless fabric web 128 into the needle loom 100, as well as tensioning the web during the needling operation. One of the rollers 131 as shown in the far right portion of FIG. 2 is driven by a motor control assembly (not shown) in order to drive the endless fabric web 128 through its endless continuous path through the upper and lower needle board zones 118, 120. Platform assembly 132 can be raised and lowered to facilitate inserting and removing of the web 128 within the needle loom 100 by means of an extendable hydraulic assembly 133.

The needle loom 100 is operated in a conventional manner to fully and completely needle the endless fabric web 128 in order to fully incorporate and lock the fibrous material which has been supplied thereto. This operation continues until the entire length of the endless fabric web 128 has the fibrous material fully needled thereto along its entire length. Depending upon the speed of operation of the needling operation, the number of needles used, and the amount of needling required to fully lock the fibrous material to the underlying endless fabric web 128, a number of passes past the needle board modules 116 may be required. After completion of full-width needling of the fibrous material to the endless fabric web 128, the web is removed from the needle loom 100 and then subjected to further operations, as is conventional. Such further operation may include the needling of additional layers of fibrous material to the endless fabric web 128 and/or surface conditioning and/or other heat treating operations with respect to the needled web. These additional operations generally are accomplished on other machines (not shown). A further description of the operation of a needle loom 100, such as the needle loom illustrated in FIGS. 1–3, is disclosed in the aforementioned United States patents, which operation is incorporated herein by reference.

Referring generally to FIGS. 4–7, there is illustrated a needle board 126 which is shown as having a rectangular shape including side edges 134, 136, 138, 140 delineating a top surface 142 and a bottom surface 144. It is to be understood that the needle board 126 can be constructed in a multitude of geometries, materials and configurations. In accordance with the present invention, the needle board 126 is provided with certain construction features which, as to be described hereinafter, provide the needle board with certain attributes which facilitate its use in a needle loom.

In accordance with one embodiment, the needle board 126 is provided with a plurality of spaced apart elongated openings 146 which extend between the top and bottom surfaces 142, 144 adjacent side edges 134, 138. A wheel 148 is rotatably journaled within each of the openings 146 by means of an axle 150. The diameter of each wheel 148 is sized and/or located so as to have a circumferential portion extending at least below the bottom surface 144 of the needle board 126, see FIG. 5. It is also contemplated that a circumferential portion of the wheels may extend above the top surface 142 of the needle board 126. The wheels 148 allow the needle loom operator to roll the needle board 126 into or out of the needle board modules 116 with minimal physical effort. The needle board modules 116 are provided with a plurality of colinearly aligned guides (see FIG. 16) which cooperate with the wheels 148 to allow the needle boards 126 to be rolled the entire length of the needle loom 100 for removal of the needle boards at the opened end of the needle loom, that is, the far left end of the needle loom as shown in FIG. 3.

Also located adjacent the side edges 134, 138 and projecting upwardly away from top surface 142 are at least one and preferably a plurality of spaced apart needle board locators 152. The locators 152 in accordance with one embodiment are constructed as precision machined locating pins that are used to accurately align the needle boards 126 in a respective needle board module 116 before they are clamped in place. The locators 152 eliminate the time previously required by the needle loom operator to manually align the needle boards 126 prior to clamping in the needle board modules 116. By way of example, the locators 152 are shown as 180° of a conical member having its bisecting surface 154 in flush alignment with the side edges 134, 138. As to be described hereinafter, the locators 152 are operative for engagement with a recess, opening or other conforming portion of the needle board module 116. Thus, it is to be understood that the locators 152 can be constructed in a variety of shapes and sizes so as to accurately align the needle board 126 in its corresponding needle board module 116.

The needle boards 126 are provided with connecting links 156 arranged, for example, extending outwardly from opposing side edges 136, 140. The connecting links 156 are constructed from an elongated bar 158 having one end secured to the needle board 126 and another end extending outwardly beyond its corresponding side edge 136, 140. The free end of the connecting link 156 extending beyond the needle board 126 is provided with a downwardly extending pin 160, see FIG. 5. An opening 162 is provided adjacent edges 136, 140 in alignment with a connecting link 156 of an adjacent needle board 126. The pin 160 is operative for being captured in the opening 162 provided in an adjacent needle board 126 when the needle boards are arranged in end-to-end relationship. The openings 162 are surrounded by a recess 164 in the top surface 142 of the needle board 126. The recess 164 is shaped and sized so as to accommodate that portion of the connecting link 156 extending outwardly beyond the side edges 136,140 of an adjacent needle board 126 such that adjacent interconnected needle boards are maintained in the same horizontal plane. It is further to be understood that the connecting links 156 can be secured to the bottom surface 144 of the needle boards 126 with their pins 160 extending upwardly. In this event, the recess 164 will be provided on the bottom surface 144 of the needle board 126.

From the foregoing description, it should be appreciated that a connecting link 156 on one needle board 126 will be positioned in alignment with an opening 162 of an adjacent needle board. Individual needle boards 126 may be releasably interconnected using the connecting links 156 which allow the needle loom operator to extract all of the needle boards from a fixed position at the open end of the needle loom 100. The connecting links 156 also serve to accurately maintain the needle board to needle board positioning when installed in the needle loom 100.

Existing needle looms 100, such as those illustrated in FIGS. 1–3 which are used in the woven and non-woven industries, incorporate tens of thousands of needles mounted to the reciprocating needle boards 126 to process the endless fabric web 128. A single needle loom 100 may contain between 1 and 14 needle boards 126 per needle zone 118, 120 and are installed in the needle board modules 116 (see FIGS. 16–18 as to be described hereinafter). The needle board modules 116 are installed across the width of the needle loom 100, a single needle loom may have as many as two upper needle board zones 118 and two lower needle board zones 120. The needles themselves require frequent replacement to account for needle wear, breakage and product demands. There has heretofore been unknown an expeditious way for removing the needle boards 126 from the needle loom 100 in an efficient and economical manner so as to minimize needle loom down time.

There will now be described with reference to FIGS. 8–12, the construction and operation of a needle board storage apparatus in accordance with one embodiment of the present invention, which apparatus is generally designated by reference numeral 166. The apparatus 166 is operative to expedite the removal of needle boards 126 from the needle loom 100, and the insertion of replacement needle boards, thereby reducing needle loom down time and increasing overall needle loom performance and efficiency. The apparatus 166 and method of removing worn or damaged needle boards 126 and their replacement requires less needle loom operator intervention than existing methods. Thus, as noted hereinabove, it will be understood that the apparatus 166 may be integrated into the design of new needle looms 100, as well as being retrofitted for existing needle looms.

The apparatus 166 generally includes a housing 168, a support 170 and a utility catwalk 172. The catwalk 172 is constructed from a U-shaped platform 174 which is attached to the housing 168 along three sides thereof. A guide rail 176 surrounds the platform 174 at an elevated location. Access to the platform 174 by an operator is provided by a pair of spaced apart ladders 178 which extend on either side of the housing 168 to a ground location adjacent the support 170. The ladders 178 allow an operator to have access to the platform 174. As will be described hereinafter, the catwalk 172 is used by an operator when removing and inserting needle boards 126 from the upper needle board zone 118 of the needle loom 100.

The support 170 is constructed from a pair of spaced apart elongated brackets 180 having a caster 182 journaled at either end thereof. The brackets 180 are interconnected in spaced apart relationship by a plurality of linear slide rods 184. The housing 168 is slidably mounted to the linear slide rods 184 by means of bearings 186. The bearings 186 allow the housing 168 to be slid laterally between the brackets 180 into two positions to accommodate loading or unloading of the needle boards 126 between the apparatus 166 and the needle loom 100. Each of the brackets 180 support a locating pin assembly 188 which includes a vertically retractable rod 190. The locating pin assembly 188 is operative for securing the apparatus 166 in predetermined registration with the needle loom 100 as to be described hereinafter.

The housing 168 includes a front wall 192, a rear wall 194, a pair of sidewalls 196, 198, a top wall 200 and a bottom wall 202. A handle 204 is mounted to either sidewall 196, 198. The handle 204 facilitates positioning of the housing 168 by sliding same along the linear slide rods 184 between the brackets 180.

The apparatus 166 includes a two stage magazine 206, 208 arranged within the housing 168 in side-by-side relationship, each including a plurality of compartments 210 constructed for storage of a needle board 126. Each magazine 206, 208 is similarly constructed from two pairs of spaced apart endless chains 212, 214, for example, double pitch roller chains. One pair of endless chains 212 are positioned adjacent rear wall 194, while the other pair of endless chains 214 are positioned adjacent front wall 192. Each of the endless chains 212, 214 extend in a continuous elongated loop from top wall 200 to bottom wall 202 of the housing 168. A pair of spaced apart upper sprocket gears 216 are journaled respectively to the front and rear walls 192, 194 of the housing 168 adjacent the top wall 200. Similarly, a pair of spaced apart lower sprocket gears 218 are respectively journaled to the front and rear walls 192, 194 of the housing 168 adjacent the bottom wall 202. Opposing upper sprocket gears 216 are rotationally coupled to each other between the front and rear walls 192, 194 by means of a connecting rod 220. A similar connecting rod 222 operatively couples the lower sprocket gears 218 to each other between the front and rear walls 192, 194 of the housing 168.

The endless chains 212, 214 are respectively arranged in meshed engagement with their corresponding upper and lower sprocket gears 216, 218. A plurality of support members 224, for example, an angle iron, are positioned transversely at equal spaced apart vertical locations within each magazine 206, 208. The ends of the support members 224 are attached to a corresponding endless chain 212, 214 adjacent the front and rear walls 192, 194 of the housing 168. The support members 224 with respect to the endless chains 212, 214 within a corresponding magazine 206, 208 are arranged at a common elevation. As such, the vertical spaced apart location of the support members 224 within each of the magazines 206, 208 define the compartments 210. Each of the compartments 210 are sized to accommodate a needle board 126, one of which is shown in phantom in FIG. 10, to be peripherally supported by the spaced apart support members 224.

By driving the endless chains 212, 214 within a respective magazine 206, 208 via rotation of the corresponding upper and lower sprocket gears 216, 218, the support members 224 will be simultaneously indexed either upwardly or downwardly, thereby causing each of the compartments 210 to be indexed in a similar direction. The indexing of the compartments 210 is achieved by an upper indexing mechanism 226 and/or a lower indexing mechanism 228. The indexing mechanisms 226, 228 are located on the front wall 192 respectively adjacent the top wall 200 and bottom wall 202 of the housing 168, and centrally between the magazines 206, 208. The upper and lower indexing mechanisms 226, 228 are operatively coupled to the endless chains 212, 214 and/or upper and lower sprocket gears 216, 218 so as to effect rotation of the endless chains and hence the indexing of the compartments 210. The operative interconnection can be achieved, for example, by way of one or more intermeshed gears, belts, direct drives and the like. In addition, a clutch, not shown, is operative for connecting the upper and lower indexing mechanisms 226, 228 separately to the magazines 206, 208 for their independent operation. In this regard, the compartments 210 in magazine 206 can be indexed independently of the indexing of the compartments in magazine 208.

The front wall 192 of the housing 168 is provided with a top opening 230 adjacent the top wall 200 and a bottom opening 232 adjacent the bottom wall 202, both in registration with magazine 208. Similarly, a top opening 234 is provided adjacent the top wall 200 in registration with magazine 206 and a bottom opening 236 adjacent the bottom wall 202. As will be understood from a further description of the apparatus 166, the top openings 230, 234 are positioned at a height which is aligned with the upper needle board zone 118 within the needle loom 100, while the bottom openings 232, 236 are at a location which is aligned with the lower needle board zone 120. Each of the top and bottom openings 230, 232, 234, 236 provides access to the compartments 210 within the magazines 206, 208 for insertion and withdrawing needle boards 126 therefrom. General access to all of the compartments 210 simultaneously can be achieved through doors 238 provided on the rear wall 194 of the housing 136 in registration with each of the magazines 206, 208.

As thus far described, the upper and lower indexing mechanisms 226, 228 are manual in nature requiring rotation by the operator. However, it is to be understood that the indexing mechanisms 226, 228 can be motorized, as well as being operable under programmed computer control. In any event, operation of the magazine 206, 208 will result in the compartments 210 being indexed to an appropriate location within the housing 168 as may be required during use of the apparatus 166.

Figure 13:
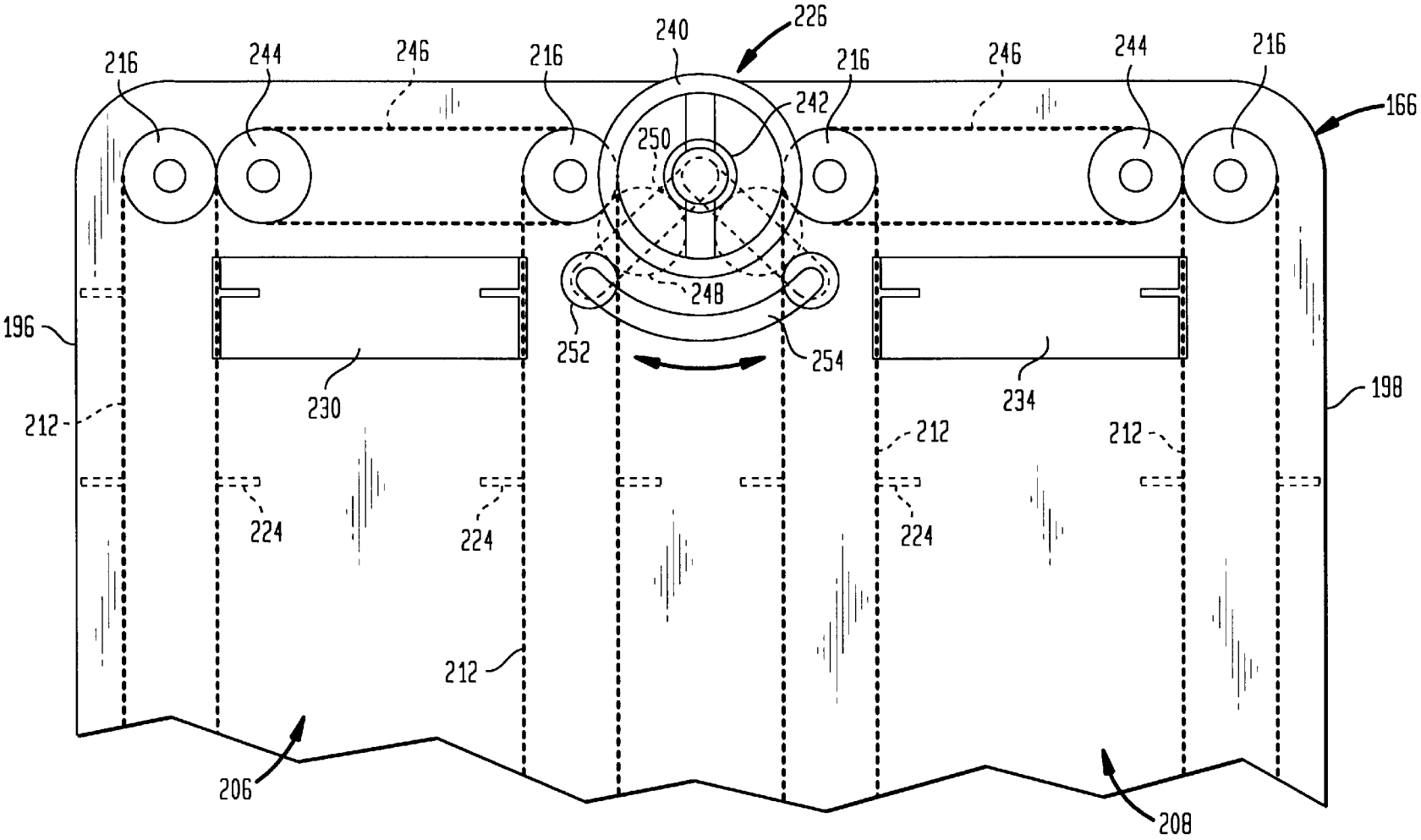
FIG. 13 is a front diagrammatical illustration showing the construction of an indexing assembly for operation of the needle board magazine in accordance with one embodiment of the present invention.

Referring to FIG. 13, a manual upper indexing mechanism 226 is illustrated constructed in accordance with one embodiment of the present invention. The indexing mechanism 226 includes a hand wheel 240 journaled to the housing 168 of the apparatus 166 between the two magazines 206, 208, for rotation by an operator. A sprocket gear 242 is attached to the hand wheel 240 for rotation therewith. A reversing sprocket gear 244 is intermeshed with one of the sprocket gears 216 within each magazine 206, 208 and linked to the other adjacent sprocket gear 216 within the magazine by an endless chain 246 or drive belt.

The individual magazines 206, 208 may be operated so as to index the compartments 210 therein by rotation of the hand wheel 240 which, in turn, causes the rotation of sprocket gear 242. The sprocket gear 242 is alternately coupled for operation of magazines 206, 208 by means of an idler sprocket gear 248 which is mounted on a pivotable support 250 for alternate meshed engagement with an adjacent sprocket gear 216. The support 250 at one end may be journaled for rotation about the axis of the sprocket gear 242 or hand wheel 240. The other end of the support 250 is provided with an extending knob 252 which protrudes through an arc-shaped opening 254 within the front wall 192 of the housing 168.

When the knob 252 is positioned at the left most end of the opening 254, the idler sprocket gear 248 by pivoting of support 250 becomes meshed in engagement with upper sprocket gear 216 of magazine 206. Upon rotation of the hand wheel 240, the journaled sprocket gear 242 will rotate the idler sprocket gear 248 which, in turn, will cause rotation of the right most upper sprocket gear 216 within the magazine 206. This will effect rotation of its coupled endless chain 212 for indexing either upwardly or downwardly depending upon the direction of rotation of the hand wheel 240. The coupling of the right most sprocket gear 216 to the left most sprocket gear 216 via reversing sprocket gear 244 will cause the other endless chain 212 to index in the same direction, either upwardly or downwardly. This construction of the magazines 206, 208 enables the support members 224 to be indexed concurrently in the same direction upon operation of the upper indexing mechanism 226. In a similar manner, the indexing mechanism 226 is operative for the magazine 208. In this regard, the knob 252 will be rotated via support 250 to its right most position within the opening 254. In this position, the idler sprocket gear 248 will be in meshed engagement with the left most sprocket gear 216 of the magazine 208 to effect rotation thereof, as well as the reversing idler gear 244 and its meshed sprocket gear 216. It is to be understood that the lower indexing mechanism 228 can be constructed in a similar manner.

Figure 14:
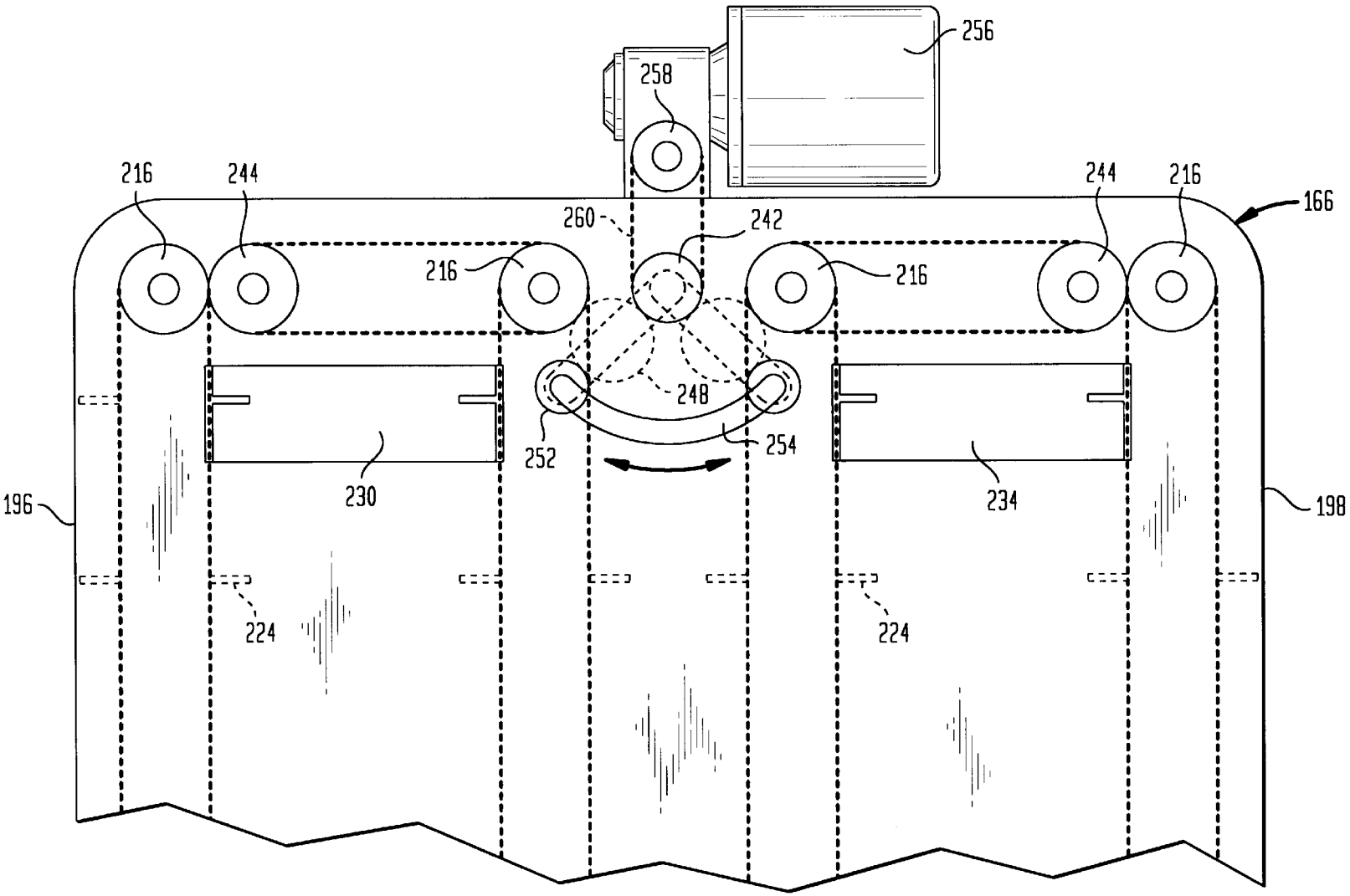
FIG. 14 is a front diagrammatical illustration showing the construction of an indexing assembly for operation of the needle board magazine in accordance another embodiment of the present invention.

The upper and lower indexing mechanisms 226, 228 have thus far been described as being manually operated. However, it is contemplated that the indexing of the magazines 206, 208 can be operated by a motor as shown in the embodiment illustrated in FIG. 14. In this regard, the hand wheel 240 is replaced by a motor 256 supporting a drive gear 258 which is coupled to the sprocket gear 242 by means of an endless chain or drive belt 260. The lower indexing mechanism 228 can be similarly motorized to enable indexing of the magazines 206, 208.

Figure 15:
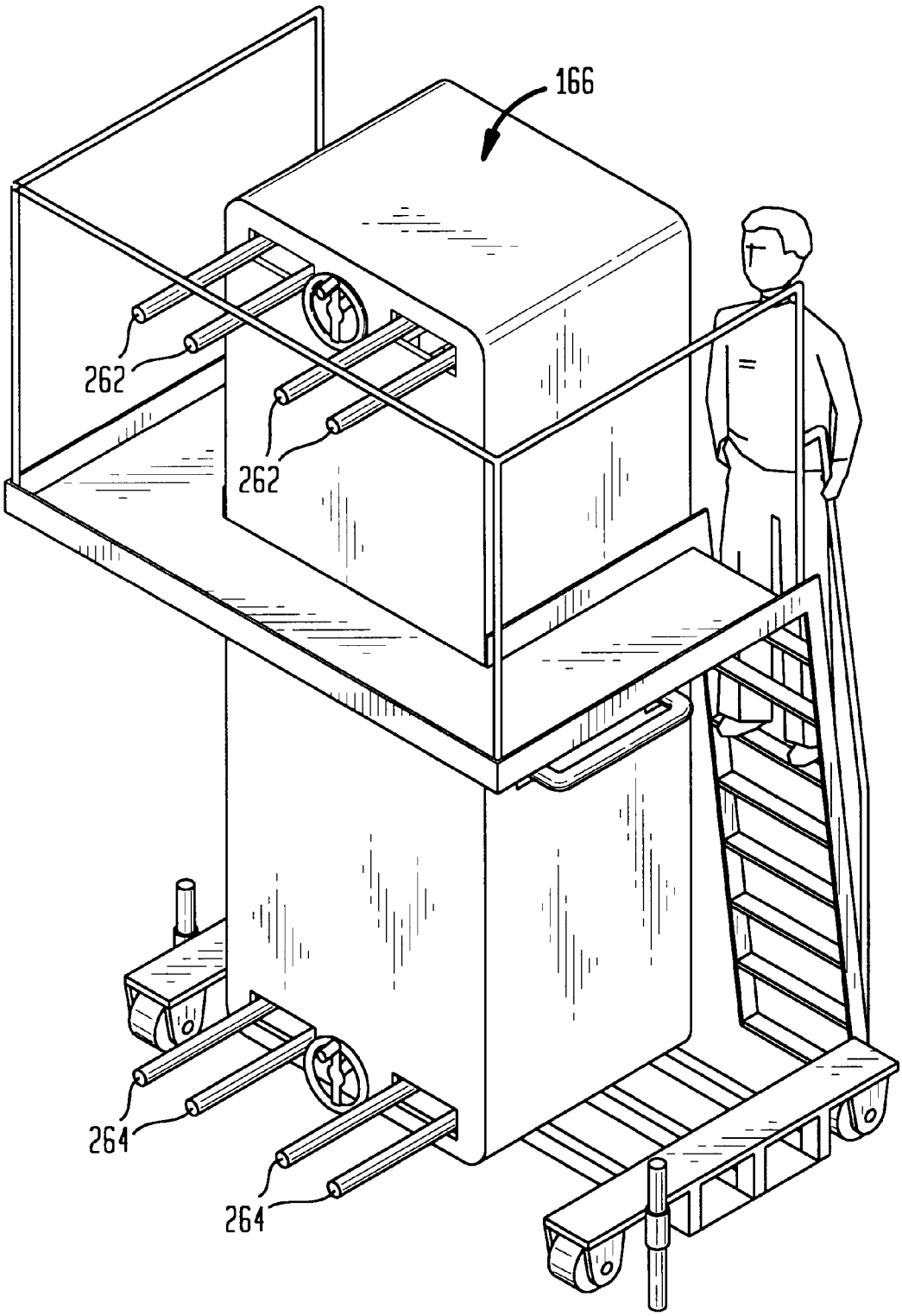
FIG. 15 is a front perspective view of a needle board storage apparatus showing extendible guide tracks for bridging the gap between the needle board storage apparatus and a needle loom.

Referring to FIG. 15, each of the magazines 206, 208 are provided with a pair of spaced apart guide tracks 262, 264 which are arranged extending outwardly through the corresponding top and bottom openings 230, 232 of magazine 208 and top and bottom openings 234, 236 of magazine 206. The guide tracks 262, 264 are retractable into the housing 168, as well as being extendible as shown. The guide tracks 262, 264 when in their extended position, bridge the gap between the apparatus 166 and the needle loom 100 so as to provide a continuous uninterrupted track upon which the needle boards 126 may be rolled, via their wheels 148, when being removed from the needle loom or inserted therein.

The construction of the needle board storage apparatus 166 having been described, there follows a description of its use in the removal of worn or damaged needle boards 126 from a needle loom 100, as well as the insertion of replacement needle boards into the loom. The apparatus 166 is initially loaded with a full complement of replacement needle boards 126. This is achieved by opening one of the doors 238 to provide access to one of the magazines 206, 208 and the plurality of empty compartments 210. As previously described, each of the magazines 206, 208 are provided with a sufficient number of compartments 210 to accommodate the number of needle boards 126 to be inserted or removed from a given upper or lower needle board zone 118, 120. With the apparatus 166 loaded with replacement needle boards 126, the apparatus is positioned adjacent the needle loom 100.

More specifically, the apparatus 166 is positioned such that when replacing needle boards from the upper needle board zone 118, the top opening 230 or 234 of the empty magazine 206 or 208 is positioned in alignment with the outermost needle board module 116 at the far left open end of the needle loom 100 as shown in FIG. 3. In the event that the needle boards 126 from the lower needle board zone 120 are to be removed, the bottom opening 232 or 236 of a corresponding empty magazine 206 or 208 will be aligned adjacent the end most needle board module 116. In this regard, the top and bottom openings 230, 232, 234, 236 are initially positioned in the apparatus 166 taking into consideration the construction of the needle loom 100 to which the apparatus will be used. It is to be noted that lateral alignment may be achieved by sliding the housing 168 between the brackets 180 by means of the linear slide rods 184.

The apparatus 166 may be positioned by rolling the apparatus along the ground via casters 182. Alternatively, the apparatus 166 may be moved into position using a fork lift truck (not shown) or any other means so as to position the apparatus adjacent the needle loom 100. To prevent movement and to ensure proper alignment of the apparatus 166, openings (not shown) in the plant floor or other support may be provided for receiving rods 190 of the locating pin assemblies 188. In this regard, the openings in the plant floor will precisely align the apparatus 166, which apparatus will be retained in position by inserting the rods 190 therein. It is to be understood that other alignment and locking techniques or assemblies may be used with the apparatus 166.

Once the apparatus 166 is secured in aligned position with the needle loom 100, the guide tracks 262, 264 are extended so as to communicate with the free open end of the needle loom 100 opposing the outermost needle board module 116 to provide a continuous guide track therebetween. It is to be understood that the guide tracks 262, 264 although being described as part of the apparatus 166, the guide tracks may be provided as a portion of the needle loom, as well as being a separate assembly which can be positioned at the time of use of the apparatus when removing and installing needle boards 126.

An operator will climb onto the catwalk 172 and position himself adjacent one of the top openings 230, 234 which provides access to an empty magazine 206, 208 when replacing needle boards 126 in the upper needle board zone 118. On the other hand, the operator will be positioned on the ground when replacing needle boards 126 in the lower needle board zone 120. In either case, the needle loom will be locked into a maintenance mode which will also de-energize the clamping of the needle boards 126 within the needle board modules 116. The clamping of the needle board within a needle board module 116 will be described hereinafter. The operator begins the needle board withdrawal process by pulling the first needle board 126 out from the needle board module 116. Withdrawal of the needle board 126 is facilitated by the wheels 148 of the needle board rolling along a portion of the needle board module 116 which provides a guide track therefore. It is to be understood that the plurality of needle boards 126 within the needle board module 116 are linked together in end-to-end relationship by means of the connecting links 156 having their pins 160 engaged in an opening 162 of an adjacent needle board. Thus, as one needle board 126 is pulled by the operator through the needle board module 116, all of the interconnected needle boards are also withdrawn simultaneously.

As the first needle board 116 is withdrawn, it is decoupled from the adjacent needle board by slightly lifting one end so as to withdraw pin 160 from opening 162 in the adjacent needle board. The freed needle board 116 is rolled along the guide tracks 162, 164 and into a corresponding top or bottom opening 230, 232, 234, 236 to place the needle board into one of the aligned compartments 210 of an empty magazine 206, 208. Once the withdrawn needle board 126 has been positioned in the magazine 206, 208, the magazine can be indexed either manually using the upper or lower indexing mechanisms 226, 228 or by motor 256 so as to expose an empty compartment 210 aligned with one of the top or bottom openings 230, 232, 234, 236. In the case where needle boards 126 are inserted into one of the bottom openings 230, 236, the corresponding magazine 206, 208 would be indexed upwardly. Similarly, the corresponding magazine 206, 208 will be indexed downwardly when the needle boards 126 are inserted through the corresponding top opening 230, 234 of an empty magazine. By repeating the foregoing sequence, the needle boards 126 may be removed from the upper and lower needle board zones 118, 120 of the needle loom 100 and stored in the apparatus 166 within an empty magazine 206, 208.

Once the needle boards 126 have been removed, the housing 168 is slid along the linear slide rods 184 to align the other top opening 230, 234 or bottom opening 232, 236 adjacent the empty needle board module 116 in the upper or lower needle board zone 118, 120. A replacement needle board 126 is withdrawn by an operator through one of the aforementioned openings and rolled along the corresponding guide tracks 262, 264 and into the needle board module 116. Subsequently, the operator will index the magazine 206, 208 containing the replacement needle boards 126 to expose the next needle board to be removed within a corresponding top opening 230, 234 or bottom opening 232, 236. The next replacement needle board 126 will be similarly rolled along the guide tracks 262, 264 and linked to the first needle board by means of the connecting links 156 as previously described. The first two needle boards 126 are now interconnected in end-to-end relationship and may be rolled further into the needle board module 116 which is facilitated by means of the wheels 148. This sequence is continued until all of the replacement needle boards within one of the magazines 206, 208 have been inserted into the needle loom 100. Subsequently, the guide tracks 262, 264 may be retracted and the apparatus 166 transported to another location where the damaged or worn needle boards can be removed through one of the doors 238 which provide access to the magazines 206, 208. Finally, the installed needle boards 126 are locked into position by a needle board clamping assembly, with the needle boards precisely located within the needle board module 116 by means of the locators 152.

Figure 16:
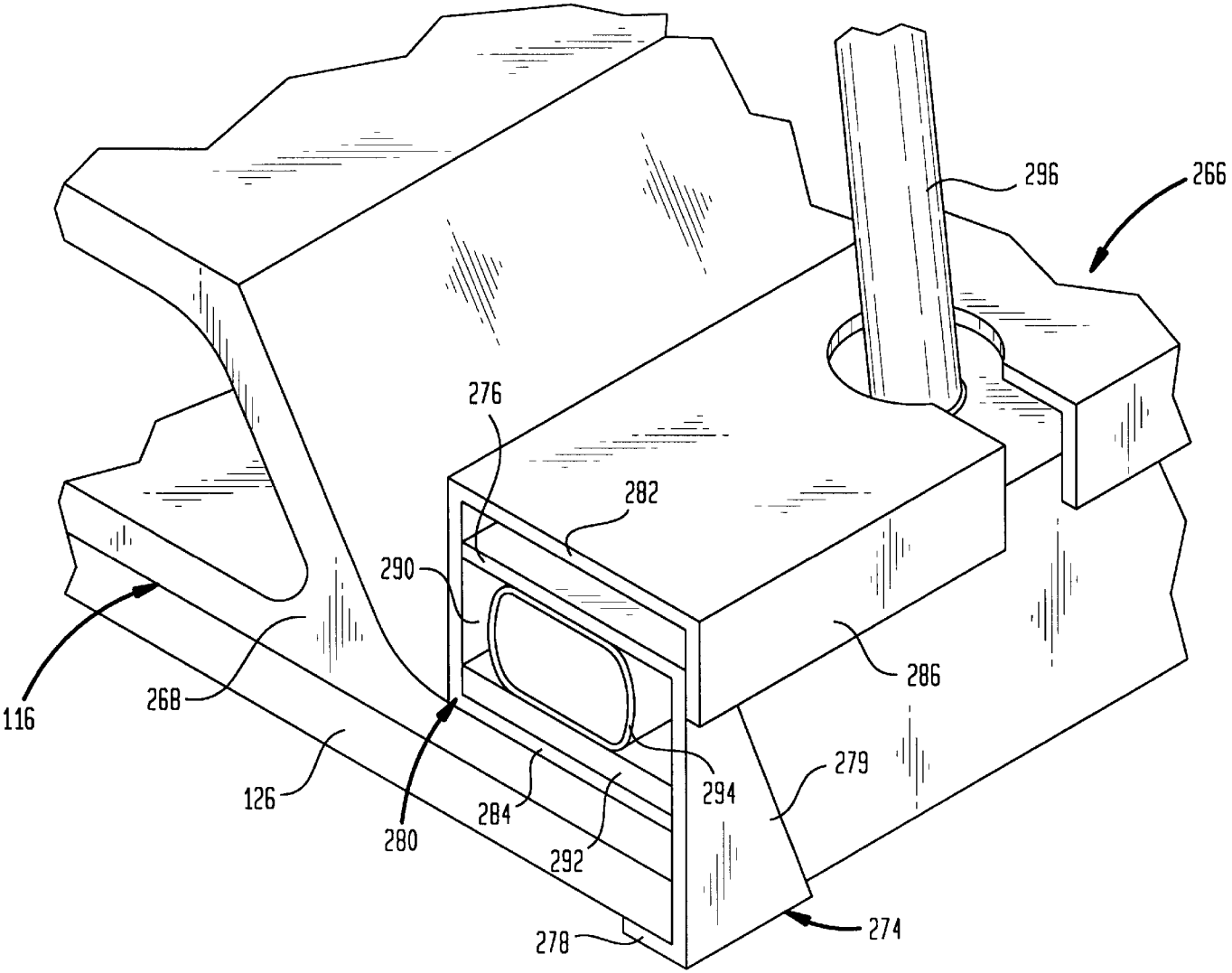
FIG. 16 is a perspective view of a portion of a clamping assembly operative for clamping needle boards in predetermined registration within a needle board module of the needle loom.
Figure 17:
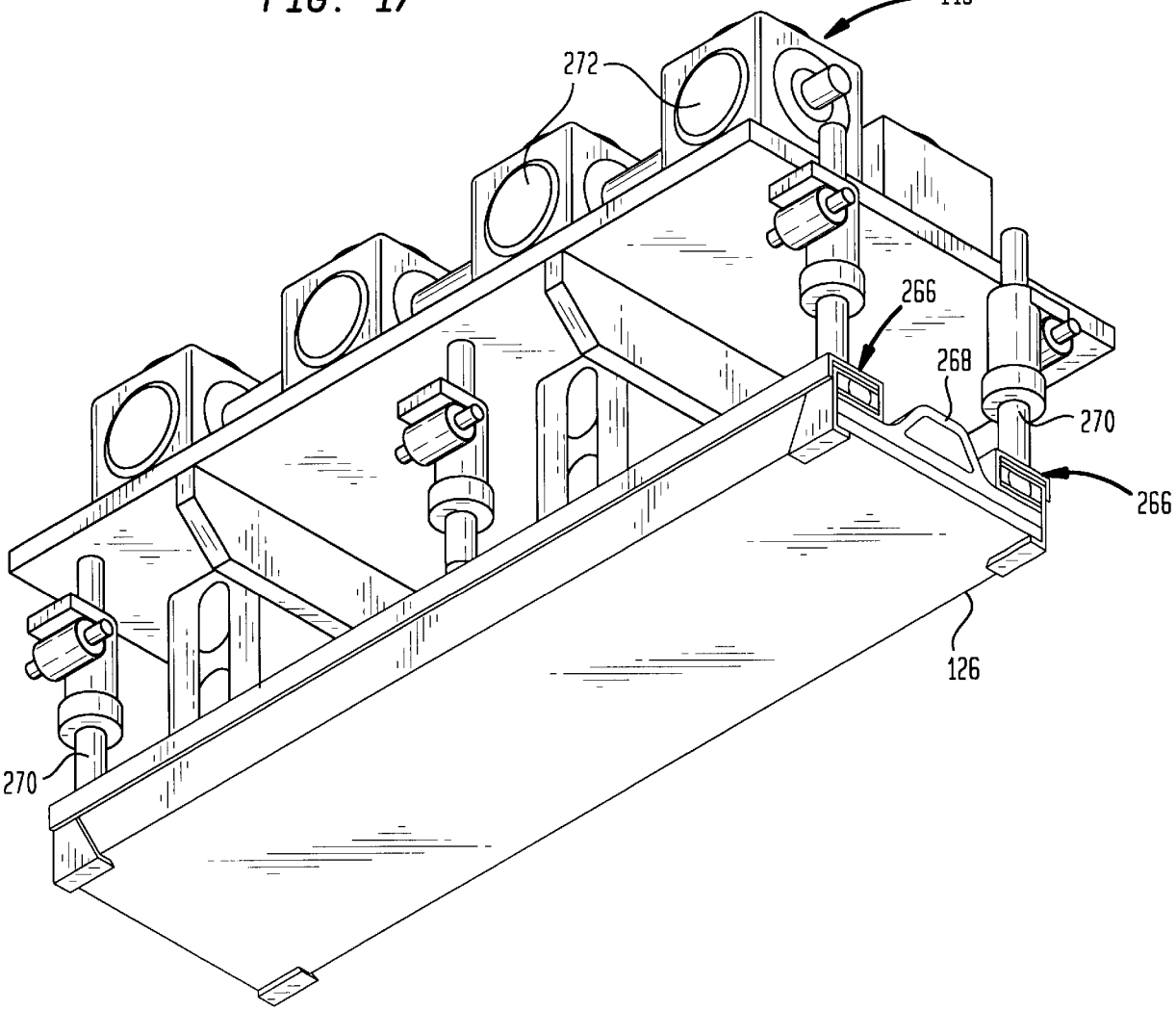
FIG. 17 is a perspective view, looking from below, of a needle board module operative for reciprocating a needle board during operation of a needle loom.
Figure 18:
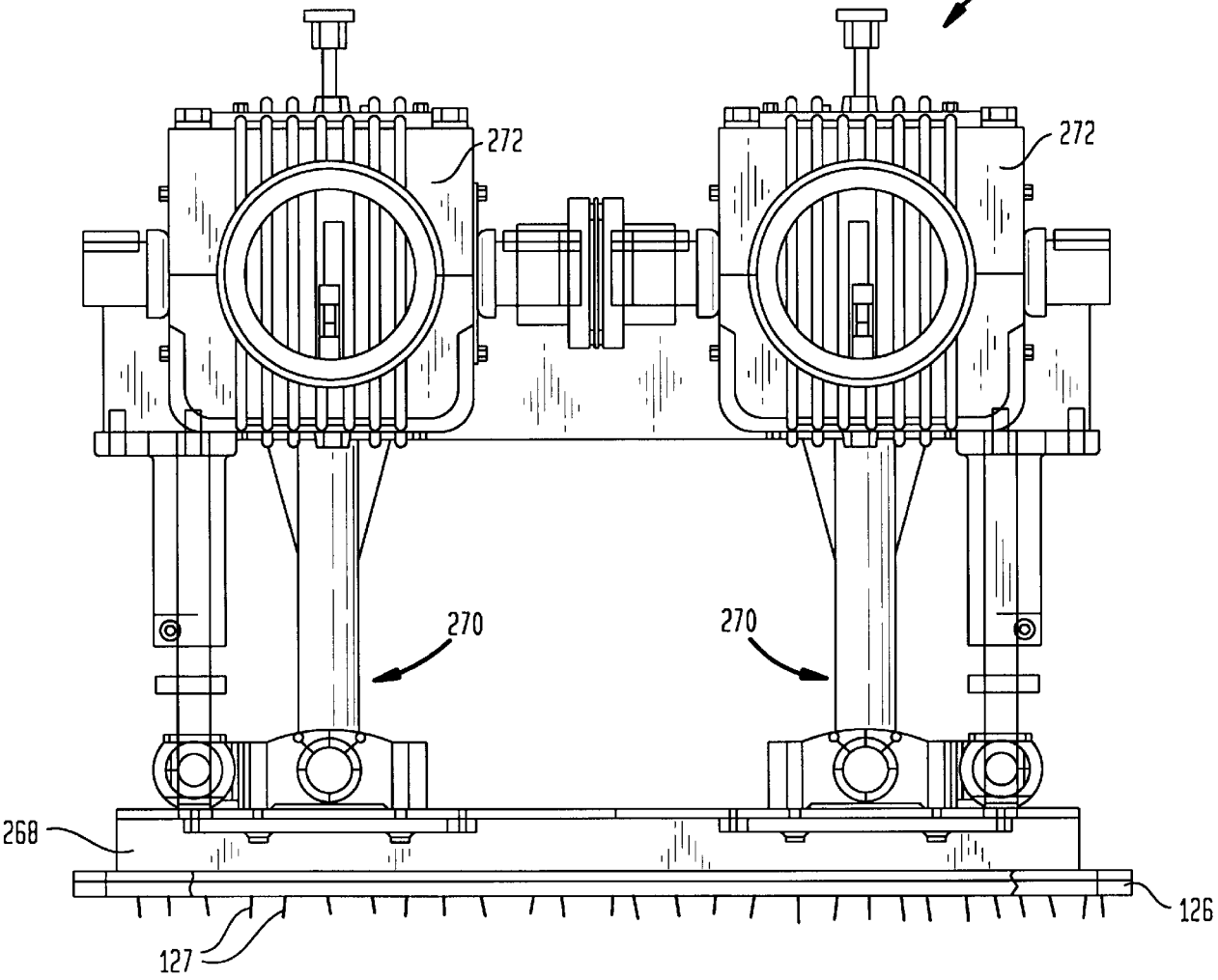
FIG. 18 is a front elevational view of the needle board module as illustrated in FIG. 14.

Referring generally to FIGS. 16–18, there is shown a needle board module 116 having a clamping assembly 266 extending along both sides thereof for clamping one or more needle boards 126 in the upper or lower needle board zones 118, 120 of the needle loom 100. The needle board module 116 includes an elongated needle beam 268 which is reciprocally supported within the needle loom 100 by a plurality of connecting rods 270 coupled to a corresponding gear housing 272 which is coupled to a drive motor (not shown). The basic construction and operation of the needle board module 116 is described in greater detail generally in U.S. Pat. No. 4,884,324, which construction and operation is incorporated herein by reference.

As best shown in FIG. 16, each clamping assembly 266 which is provided along both sides of the needle board module 116 includes a U-shaped clamping arm 274 having a long leg 276 and a short leg 278 separated by a base 279. The short legs 278 provide guide tracks to support the lateral side edges 134, 138 of the needle board 126 by means of the wheels 148, thereby providing for the rolling engagement between the needle board and the needle board module 116. Another generally U-shaped clamping arm 280 is provided with a pair of spaced apart legs 282, 284 of generally the same length and a depending flange 286 arranged downwardly projecting and transverse to leg 282 and overlying base 279 of clamping arm 274. The clamping arms 274, 280 are intermeshed opposing one another such that long leg 276 of clamping arm 274 is arranged underlying and adjacent leg 282 of clamping arm 280 to define an elongated cavity 290 between legs 276, 284. An elongated bladder support 292 is positioned within the cavity 290 supported on leg 284 of the clamping arm 280. An inflatable elongated generally oval shaped bladder 294 is positioned within the cavity 290 between the bladder support 292 and long leg 276 of the clamping arm 274. An air supply tube 276 communicates with the interior of the bladder 294.

In operation, the bladder 294 is expanded by compressed air through air supply tube 296. As the bladder 294 expands, long leg 276 of the clamping arm 274 is displaced upwardly towards leg 282 of the clamping arm 280. At the same time, the short leg 278 of the clamping arm 274 is urged upwardly against the peripheral bottom edge of the needle board 116 so as to compress same against the needle beam 268. The compressive force created by the bladder 294 will clamp the needle board 126 along side edges 134, 138 within the needle board module 116. The needle beam 268 is further provided with an opening (not shown) which is operative for receiving the locators 152 projecting upwardly from the needle board 126. The openings are arranged along the outer edge of the needle beam 268 at precision locations for effecting accurate registration of the needle board in the needle board module. The needle boards 126 may be removed from the needle board module 116 by deflating the bladder 294 so as to remove the clamping action caused by the clamping arm 274.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An apparatus for the storage of a plurality of needle boards for a needle loom, said apparatus comprising a housing, a plurality of first compartments within said housing adapted for storing a plurality of needle boards upon removal from said needle loom, a plurality of second compartments within said housing adapted for storing a plurality of needle boards to be inserted into said needle loom, and an indexing assembly in operative association with said first and second compartments, said indexing assembly positioning each of said first compartments adjacent a predetermined position within said housing for receiving a needle board removed from said needle loom and each of said second compartments adjacent another predetermined position within said housing for removing a needle board therefrom to be inserted into said needle loom.

2. The apparatus of claim 1, further including a support for said housing, said support including a pair of spaced apart brackets and a plurality of elongated rods connected therebetween.

3. The apparatus of claim 2, wherein said housing is slidably coupled to said rods for movement between said brackets.

4. The apparatus of claim 2, wherein said support further includes means on said brackets to enable movement of said apparatus over an underlying floor supporting said apparatus.

5. The apparatus of claim 2, wherein said support further includes an assembly for releasably securing said apparatus at a predetermined location.

6. The apparatus of claim 5, wherein said assembly includes at least one retractable rod attached to each of said brackets for releasable engagement with a cooperating member at said predetermined location whereby said apparatus is positionable in predetermined registration with the needle loom.

7. The apparatus of claim 6, wherein said cooperating member comprises an opening within floor supporting said apparatus for receiving said rod therein.

8. The apparatus of claim 1, wherein said housing includes a top wall and a bottom wall, said housing further including a platform extending outwardly of said housing between said top wall and said bottom wall.

9. The apparatus of claim 1, wherein said plurality of first and second compartments are arranged in first and second adjacent columns within said housing.

10. The apparatus of claim 9, wherein said plurality of first and second compartments include a plurality of spaced apart support members each attached between a pair of endless chains.

11. The apparatus of claim 10, further including a plurality of gears each meshed with at least one of said endless chains.

12. The apparatus of claim 11, wherein said indexing assembly includes a gear moveable between a first and second position for operatively coupling said indexing assembly alternatively between said first and second compartments.

13. The apparatus of claim 12, wherein said indexing assembly includes means for rotating said gear when in said first and second positions.

14. An apparatus for the storage of a plurality of needle boards for use in a needle loom, said apparatus comprising a housing including a front side having first and second openings therein, a first storage area within said housing including a plurality of first compartments each movable to a position opposing said first opening for receiving a needle board removed from said needle loom, a second storage area within said housing including a plurality of second compartments each movable to a position opposing said second opening for storing replacement needle boards to be inserted into said needle loom, and an indexing assembly operatively associated with said first and second compartments, said indexing assembly positioning each of said first compartments opposing said first opening and each of said second compartments opposing said second opening.

15. The apparatus of claim 14, further including a support for said housing, said support including a pair of spaced apart brackets and a plurality of elongated rods connected therebetween.

16. The apparatus of claim 14, wherein said housing is slidably coupled to said rods for movement between said brackets.

17. The apparatus of claim 14, wherein said support further includes an assembly for releasably securing said apparatus at a predetermined location.

18. The apparatus of claim 17, wherein said assembly includes at least one retractable rod attached to each of said brackets for releasable engagement with a cooperating member at said predetermined location whereby said apparatus is positionable in predetermined registration with the needle loom.

19. The apparatus of claim 18, wherein said cooperating member comprises an opening with a floor supporting said apparatus for receiving said rod therein.

20. The apparatus of claim 14, wherein said plurality of first and second compartments are arranged in first and second adjacent columns within said housing.

21. The apparatus of claim 20, wherein said plurality of first and second compartments include a plurality of spaced apart support members each attached between a pair of endless chains.

22. The apparatus of claim 21, further including a plurality of gears each meshed with at least one of said endless chains.

23. The apparatus of claim 22, wherein said indexing assembly includes a gear moveable between a first and second position for operatively coupling said indexing assembly alternatively between said first and second compartments.

24. The apparatus of claim 23, wherein said indexing assembly includes means for rotating said gear when in said first and second positions.

25. The apparatus of claim 14, wherein said first and second opening are arranged adjacent the top of said front side, and further including a third and fourth opening adjacent the bottom of said front side.

26. The apparatus of claim 25, wherein said plurality of first compartments are each moveable to a position opposing said third opening for inserting a needle board removed from said needle loom and said plurality of second compartments are each moveable to a position opposing said fourth opening for removing stored replacement needle boards to be inserted into said needle loom.

27. The apparatus of claim 14, further including a guide track extendable from said housing for supporting said needle boards between said housing and the needle loom.

28. A needle board for use in a needle loom, said needle board comprising a substrate bound by a plurality of edges having an opening adjacent one edge thereof, a pin protruding from one edge of said substrate for capture within said opening within a substrate of an adjacent needle board thereby releasably interconnecting at least a pair of said needle boards together, a locator adjacent one edge of said substrate for engagement with a portion of said needle loom when said substrate is inserted therein, thereby aligning said substrate within said needle loom at a predetermined position, and a wheel adjacent an edge of said substrate for engagement with said needle loom thereby facilitating the insertion of said substrate within said needle loom.

29. The needle board of claim 28, further including a first bar having one end attached to said substrate and the other end extending outwardly therebeyond, said pin attached to said other end of said bar.

30. The needle board of claim 29, wherein said pin extends upwardly from said bar.

31. The needle board of claim 29, wherein said pin extends downwardly from said bar.

32. The needle board of claim 28, further including a second bar having one end attached to said substrate and the other end extending outwardly therebeyond and a pin attached to said other end, said bars being arranged adjacent opposite corners of said substrate.

33. The needle board of claim 28, further including another locator adjacent another edge of said substrate, said locators being arranged adjacent opposite edges of said substrate.

34. The needle board of claim 33, wherein said locators are in the shape of a portion of a conical member.

35. The needle board of claim 28, wherein said substrate includes a pair of spaced wheels adjacent one edge of said substrate and another pair of spaced wheels adjacent an opposite edge of said substrate.

36. A needle board for use in a needle board module having a guide track for the insertion and removal of needle boards from within a needle loom, said needle board comprising a substrate having a plurality of needles bound by a pair of side edges and a pair of end edges, a connecting link protruding outwardly from one of said end edges of said substrate having a pin for capture within an opening within a substrate of an adjacent needle board thereby releasably interconnecting a pair of said needle boards together in end-to-end relationship, a locator adjacent one of said side edges of said substrate for engagement with a portion of said needle board module when said needle board is received therein along said guide track thereby aligning said needle board within said needle board module at a predetermined position, a wheel adjacent each of said side edges of said substrate for rolling engagement along said guide track thereby facilitating insertion of a plurality of needle boards into said needle board module when said needle boards are interconnected by means of said connecting link.

37. The needle board of claim 36, further including another connecting link protruding outwardly from the other end edge of said substrate having a pin for capture within an opening within a substrate of an adjacent needle board.

38. The needle board of claim 36, further including another locator adjacent the other side edge of said substrate.

39. The needle board of claim 38, wherein said pin extends downwardly from said connecting link.

40. The needle board of claim 36, wherein said substrate includes a pair of spaced wheels adjacent each of said side edges of said substrate.

41. A system for inserting and removing a plurality of needle boards from a needle loom, said system comprising a plurality of needle boards insertable and removable from said needle loom at one end thereof, a needle board storage apparatus moveable to a position adjacent said one end of said needle loom, said apparatus including a plurality of first compartments adapted for storing a plurality of needle boards upon removal from said needle loom and a plurality of second compartments adapted for storing a plurality of needle boards to be inserted into said needle loom, and an indexing assembly in operative association with said first and second compartments, said indexing assembly positioning each of said first compartments adjacent a predetermined position within said apparatus for receiving a needle board removed from said needle loom and each of said second compartments adjacent another predetermined position within said apparatus for removing a needle board therefrom to be inserted into said needle loom.

42. The system of claim 41, wherein said apparatus includes a housing containing said plurality of said first and second compartments.

43. The system of claim 42, further including a support for said housing, said support including a pair of spaced apart brackets and a plurality of elongated rods connected therebetween.

44. The system of claim 43, wherein said housing is slidably coupled to said rods for movement between said brackets.

45. The system of claim 43, wherein said support further includes means on said brackets to enable movement of said apparatus over an underlying floor supporting said apparatus.

46. The system of claim 43, wherein said support further includes an assembly for releasably securing said apparatus at a predetermined location.

47. The system of claim 46, wherein said assembly includes at least one retractable rod attached to each of said brackets for releasable engagement with a cooperating member at said predetermined location whereby said apparatus is positionable in predetermined registration with the needle loom.

48. The system of claim 47, wherein said cooperating member comprises an opening within a floor supporting said apparatus for receiving said rod therein.

49. The system of claim 41, wherein said apparatus includes a top wall and a bottom wall, said apparatus further including a platform extending outwardly of said apparatus between said top wall and said bottom wall.

50. The system of claim 41, wherein said plurality of first and second compartments are arranged in first and second adjacent columns within said apparatus.

51. The system of claim 50, wherein said plurality of first and second compartments include a plurality of spaced apart support members each attached between a pair of endless chains.

52. The system of claim 51, further including a plurality of gears each meshed with at least one of said endless chains.

53. The system of claim 52, wherein said indexing assembly includes a gear moveable between a first and second position for operatively coupling said indexing assembly alternatively between first and second compartments.

54. The system of claim 53, wherein said indexing assembly includes means for rotating said gear when in said first and second positions.

55. The system of claim 41, wherein said needle boards comprise a substrate bound by a plurality of edges having an opening adjacent one edge thereof, a pin protruding from one edge of said substrate for capture within said opening within a substrate of an adjacent needle board thereby releasably interconnecting at least a pair of said needle boards together, a locator adjacent one edge of said substrate for engagement with a portion of said needle loom when said substrate is inserted therein, thereby aligning said substrate within said needle loom at a predetermined position, and a pair of spaced wheels adjacent one edge of said substrate and another pair of spaced wheels adjacent an opposite edge of said substrate for engagement with said needle loom thereby facilitating the insertion of said substrate within said needle loom.

56. The system of claim 55, further including a first bar having one end attached to said substrate and the other end extending outwardly therebeyond, said pin attached to said other end of said bar.

57. The system of claim 56, wherein said pin extends upwardly from said bar.

58. The system of claim 56, wherein said pin extends downwardly from said bar.

59. The system of claim 55, further including a second bar having one end attached to said substrate and the other end extending outwardly therebeyond and a pin attached to said other end, said bars being arranged adjacent opposite corners of said substrate.

60. The system of claim 55, further including another locator adjacent another edge of said substrate, said locators being arranged adjacent opposite edges of said substrate.

61. The system of claim 60, wherein said locators are in the shape of a portion of a conical member.

62. A system for inserting and removing a plurality of needle boards from a needle loom, said system comprising a needle loom having at least one needle zone operative for reciprocating a plurality of needle board modules therein, said needle board modules including a guide track for moveable support of said needle boards into and out of said needle board modules at one end of said needle loom for replacement of said needle boards, a needle board storage apparatus moveable from a first position adjacent said one end of said needle loom to a second position remote therefrom, said apparatus including a front side having a first and second opening, a first storage area within said apparatus including a plurality of first compartments each movable to a position opposing said first opening within said front side for receiving a needle board removed from said needle board modules, a second storage area within said apparatus including a plurality of second compartments each movable to a position opposing said second opening within said front side adapted for receiving therethrough a needle board stored within said second compartments for insertion into said needle board modules, and an indexing assembly operatively associated with said first and second compartments, said indexing assembly positioning each of said first compartments opposing said first opening for receiving said needle boards from said needle loom for storage within said first storage area and positioning each of said second compartments opposing said second opening for withdrawing a needle board through said second opening from an opposing second compartment for insertion into said needle loom.

63. The system of claim 62, wherein said apparatus includes a housing containing said plurality of said first and second compartments.

64. The system of claim 63, further including a support for said housing, said support including a pair of spaced apart brackets and a plurality of elongated rods connected therebetween.

65. The system of claim 64, wherein said housing is slidably coupled to said rods for movement between said brackets.

66. The system of claim 64, wherein said support further includes means on said brackets to enable movement of said apparatus over an underlying floor supporting said apparatus.

67. The system of claim 64, wherein said support further includes an assembly for releasably securing said apparatus at a predetermined location opposing said needle zone.

68. The system of claim 67, wherein said assembly includes at least one retractable rod attached to each of said brackets for releasable engagement with a cooperating member at said predetermined location whereby said apparatus is positionable in predetermined registration with the needle zone.

69. The system of claim 68, wherein said cooperating member comprises an opening within a floor supporting said apparatus for receiving said rod therein.

70. The system of claim 62, wherein said apparatus includes a top wall and a bottom wall, said apparatus further including a platform extending outwardly of said apparatus between said top wall and said bottom wall.

71. The system of claim 62, wherein said plurality of first and second compartments are arranged in first and second adjacent columns within said apparatus.

72. The system of claim 71, wherein said plurality of first and second compartments include a plurality of spaced apart support members each attached between a pair of endless chains.

73. The system of claim 72, further including a plurality of gears each meshed with at least one of said endless chains.

74. The system of claim 73, wherein said indexing assembly includes a gear moveable between a first and second position for operatively coupling said indexing assembly alternatively between first and second compartments.

75. The system of claim 74, wherein said indexing assembly includes means for rotating said gear when in said first and second positions.

76. The system of claim 62, wherein said first and second opening are arranged adjacent the top of said front side, and further including a third and fourth opening adjacent the bottom of said front side.

77. The system of claim 76, wherein said plurality of first compartments are each moveable to a position opposing said third opening for inserting a needle board removed from said needle board modules and said plurality of second compartments are each moveable to a position opposing said fourth opening for removing stored replacement needle boards to be inserted into said needle board modules.

78. The system of claim 62, further including a guide track extendable from said apparatus for supporting said needle boards between said apparatus and said needle board modules.

79. The system of claim 62, wherein said needle boards comprises a substrate having a plurality of needles bound by a pair of side edges and a pair of end edges, a connecting link protruding outwardly from one of said end edges of said substrate having a pin for capture within an opening within a substrate of an adjacent needle board thereby releasably interconnecting a pair of said needle boards together in end-to-end relationship, a locator adjacent one of said side edges of said substrate for engagement with a portion of said needle board module when said needle board is received therein along said guide track thereby aligning said needle board within said needle board module at a predetermined position, a pair of wheels adjacent each of said side edges of said substrate for rolling engagement along said guide track thereby facilitating insertion of a plurality of needle boards into said needle board module when said needle boards are interconnected by means of said connecting link.

80. The system of claim 79, further including another connecting link protruding outwardly from the other end edge of said substrate having a pin for capture within an opening within a substrate of an adjacent needle board.

81. The system of claim 80, wherein said pin extends downwardly from said connecting link.

82. The system of claim 80, wherein said pin extends upwardly from said connecting link.

83. The system of claim 79, further including another locator adjacent the other side edge of said substrate.

84. The system of claim 83, wherein said locators are in the shape of a portion of a conical member.

85. A method of replacing a plurality of needle boards in a needle loom, said method comprising the steps of positioning a needle board storage apparatus adjacent said needle loom having a plurality of needle boards to be replaced, said apparatus including a plurality of first and second compartments, inserting a plurality of replacement needle boards into a corresponding plurality of said second compartments, withdrawing each of said needle boards from said needle loom and inserting the withdrawn needle boards into a corresponding plurality of first compartments, and removing said replacement needle boards from said second compartments and inserting said replacement needle boards into said needle loom.

86. The method of claim 85, wherein the step of positioning said needle board storage apparatus comprises releasably securing said apparatus at a predetermined location relative to said needle loom.

87. The method of claim 85, further including the steps of indexing said plurality of first compartments within said apparatus for positioning an empty one of said first compartments at a location therein opposing the location of said needle board being withdrawn from said needle loom, and inserting the withdrawn needle board into said empty one of said first compartments.

88. The method of claim 87, further including continuing said indexing, withdrawing and inserting steps until all of said needle boards within said needle loom have been withdrawn therefrom and inserted into said plurality of first compartments.

89. The method of claim 85, further including the steps of indexing said plurality of second compartments within said apparatus for positioning one of said second compartments containing a replacement needle board at a location therein opposing the location of the needle loom where said replacement needle boards are to be inserted, and withdrawing said replacement needle board from said second compartment opposing the location where said replacement needle boards are to be inserted and inserting said replacement needle board into said needle loom.

90. The method of claim 89, further including continuing said removing, indexing and inserting steps until said plurality of replacement needle boards within said plurality of second compartments have been removed therefrom and inserted into said needle loom.

91. The method of claim 85, further including the step or releasably interconnecting said replacement needle boards in end-to-end relationship as said replacement needle boards are being inserted into said needle loom.

92. A method of replacing a plurality of needle boards in a needle loom, said needle loom having at least one needle zone operative for reciprocating a plurality of needle boards therein, said method comprising the steps of positioning a needle board storage apparatus adjacent said needle loom opposing said needle zone, said apparatus including a plurality of first and second compartments each operative for storing a needle board therein, said first compartments being accessible through a first opening in said apparatus and said second compartments being accessible through a second opening in said apparatus, connecting said apparatus to said needle loom to provide communication between said apparatus and said needle zone, inserting a plurality of replacement needle boards into a corresponding plurality of second compartments, withdrawing each of said needle boards from within said needle zone, sequentially aligning each of said first compartments with said first opening in said apparatus and inserting into the aligned first compartments said needle boards removed from said needle zone, sequentially aligning each of said second compartments with said second opening in said apparatus and withdrawing each of said replacement needle boards from said apparatus, and inserting the withdrawn replacement needle boards into said needle zone in end to end relationship.

93. The method of claim 92, wherein the step of positioning said needle board storage apparatus comprises releasably securing said apparatus at a predetermined location relative to said needle zone.

94. The method of claim 92, further including the step or releasably interconnecting said replacement needle boards in said end-to-end relationship as said replacement needle boards are being inserted into said needle zone.

95. The method of claim 92, wherein said connecting step includes positioning a pair of guide tracks between said apparatus and said needle loom in registration within said needle zone, said guide tracks supporting said needle boards therebetween.

* * * * *

UNITED STATES PATENT AND TRADEMARK OFFICE

CERTIFICATE OF CORRECTION

PATENT NO. : 6,003,215

DATED : December 21, 1999

INVENTOR(S) : St. Jacques

It is certified that error appears in the above-identified patent and that said Letters Patent is hereby corrected as shown below:

Title page, item [57],

In the Abstract, line 3, "two stage" should read -- two-stage --.

Column 1, line 15, "include" should read -- includes --.
Column 1, line 27, "cross lapping" should read -- cross-lapping --.
Column 1, line 30, "cross lapping" should read -- cross-lapping --.
Column 2, line 10, "papermakers" should read -- papermakers' --.
Column 4, line 59, "descried" should read -- described --.
Column 6, line 66, "two" should read -- two- --.
Column 7, line 13, after "accordance" insert -- with --.
Column 10, line 53, "two stage" should read -- two-stage --.
Column 10, line 59, "are" should read -- is --.
Column 10, line 61, "are" should read -- is --.
Column 10, line 65, "are" should read -- is --.
Column 16, line 58, "include" should read -- includes --.
Column 17, line 37, "are" should read -- is --.
Column 17, line 40, "include" should read -- includes --.
Column 17, line 59, "are" should read -- is --.
Column 17, line 62, "are" should read -- is --.

UNITED STATES PATENT AND TRADEMARK OFFICE
CERTIFICATE OF CORRECTION

PATENT NO. : 6,003,215

DATED : December 21, 1999

INVENTOR(S) : St. Jacques

It is certified that error appears in the above-identified patent and that said Letters Patent is hereby corrected as shown below:

Column 19, line 48, "are" should read -- is --.
Column 19, line 51, "include" should read -- includes --.
Column 21, line 21, "are" should read -- is --.
Column 21, line 24, "include" should read -- includes --.
Column 21, line 37, "opening" should read -- openings --.
Column 21, line 44, "are" should read -- is --.
Column 21, line 52, "comprises" should read -- comprise --.
Column 22, line 55, "have" should read -- has --.
Column 22, line 57, "or" should read -- of --.
Column 23, line 17, "end to end" should read -- end-to-end --.
Column 24, line 5, "or" should read -- of --.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*